US011618665B1

(12) United States Patent
Abeygunawardana et al.

(10) Patent No.: US 11,618,665 B1
(45) Date of Patent: Apr. 4, 2023

(54) BEVERAGE-DISPENSING APPLIANCE HAVING A SIGNAL SHIELD

(71) Applicant: Haier US Appliance Solutions, Inc., Wilmington, DE (US)

(72) Inventors: Danister Abeygunawardana, Jeffersonville, IN (US); Jianwu Li, Louisville, KY (US); Gregory Scott Carr, Louisville, KY (US); Brent Alden Junge, Evansville, IN (US); Timothy Ray Jackson, Louisville, KY (US); Jordan Andrew Waymeyer, Louisville, KY (US); Michael C. Watanabe, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/493,256

(22) Filed: Oct. 4, 2021

(51) Int. Cl.
*B67D 1/12* (2006.01)
*B67D 1/08* (2006.01)

(52) U.S. Cl.
CPC ..... *B67D 1/1247* (2013.01); *B67D 1/0888* (2013.01); *B67D 2001/1263* (2013.01); *B67D 2210/00039* (2013.01)

(58) Field of Classification Search
CPC ..... B67D 1/0888; B67D 1/1247; B67D 2001/1263; B67D 2210/00039
USPC ..... 222/64
See application file for complete search history.

(56) References Cited

U.S. PATENT DOCUMENTS 3,638,392 A * 2/1972 Welker, Jr. ..... G07F 13/065 141/105
3,638,448 A 2/1972 Raymer
3,721,369 A * 3/1973 Conti et al. ..... B01F 23/236 222/67
4,202,387 A * 5/1980 Upton ..... G01S 17/04 222/37
4,446,896 A * 5/1984 Campagna ..... B67D 1/1236 141/198
5,492,250 A * 2/1996 Sardynski ..... B67D 1/16 222/129.1

(Continued)

FOREIGN PATENT DOCUMENTS

CN 109422342 A 3/2019
CN 209951070 U 1/2020

(Continued)

*Primary Examiner* — Paul R Durand
*Assistant Examiner* — Michael J. Melaragno
(74) *Attorney, Agent, or Firm* — Dority & Manning, P.A.

(57) ABSTRACT

A beverage-dispensing appliance may include a cabinet, a liquid line, a liquid level sensor, and a signal shield. The cabinet may define a mutually-orthogonal vertical direction, lateral direction, and transverse direction. The cabinet may define a dispenser recess. The liquid line may be mounted to the cabinet and define a liquid outlet above the dispenser recess. The liquid level sensor may be mounted to the cabinet and directed at the dispenser recess. The signal shield may be movably mounted to the cabinet. The signal shield may be movable between a blocking position and a permissive position. The blocking position may laterally bound at least a portion of the dispenser recess. The permissive position may be transversely spaced apart from the dispenser recess to permit lateral access thereto.

20 Claims, 19 Drawing Sheets

(56) References Cited

U.S. PATENT DOCUMENTS 5,671,604 A * 9/1997 Rudick ..... F25D 3/105 62/52.1
5,797,519 A * 8/1998 Schroeder ..... B67D 1/0032 222/129.1
5,799,822 A * 9/1998 Rudewicz ..... H05B 6/808 219/678
6,116,460 A * 9/2000 Kim ..... G07F 13/10 221/96
6,880,358 B2 * 4/2005 Lucas ..... F25C 5/24 62/344
8,651,328 B2 * 2/2014 Cittadino ..... A47K 5/1202 250/482.1
2002/0014495 A1 * 2/2002 Sato ..... G07F 13/10 221/191
2002/0084284 A1 * 7/2002 Landers ..... B67D 1/0044 222/129.1
2006/0131323 A1 * 6/2006 Akuzawa ..... G07F 13/065 221/123
2006/0191592 A1 * 8/2006 Akuzawa ..... G07F 13/10 141/192
2007/0084876 A1 * 4/2007 Ardern ..... G07F 11/1653 221/258
2008/0105331 A1 * 5/2008 You ..... B67D 1/0888 141/95
2009/0095165 A1 * 4/2009 Nosler ..... A47J 31/007 426/433
2010/0024657 A9 * 2/2010 Nosler ..... A47J 31/36 426/433
2011/0088560 A1 * 4/2011 Nosler ..... A47J 31/06 99/290
2012/0029690 A1 * 2/2012 Bruck ..... G07F 11/12 221/92
2012/0138629 A1 * 6/2012 Ashrafzadeh ..... B67D 1/0858 222/1
2012/0285986 A1 * 11/2012 Irvin ..... B67D 1/0888 222/30
2013/0061981 A1 * 3/2013 Bragg ..... G07F 13/10 141/105
2013/0126042 A1 * 5/2013 Dewald ..... G07F 11/44 141/105
2014/0001199 A1 * 1/2014 Bruck ..... G07F 9/009 221/131
2014/0120235 A1 * 5/2014 Jones ..... G07F 17/0064 901/30
2014/0272049 A1 * 9/2014 Azzano ..... A47J 31/4403 426/433
2015/0144652 A1 * 5/2015 Kline ..... G07F 9/023 222/23
2017/0021929 A1 * 1/2017 McKee ..... B64D 11/0691
2017/0035240 A1 * 2/2017 Tanida ..... A47J 31/465
2019/0062137 A1 * 2/2019 Schick ..... B67D 1/1247
2019/0086940 A1 * 3/2019 Zhang ..... B65B 3/06
2019/0219338 A1 * 7/2019 Gan ..... F28D 9/0093
2019/0377973 A1 * 12/2019 Jin ..... G06V 20/00
2020/0031651 A1 * 1/2020 Schneidewend ..... A47J 31/461
2020/0074783 A1 * 3/2020 Claghorn ..... G06Q 20/3278
2020/0122994 A1 * 4/2020 Cimatti ..... B67D 1/0034
2020/0122995 A1 * 4/2020 Chernov ..... G01S 7/481
2020/0290860 A1 * 9/2020 Lynch ..... B67D 1/0014
2021/0078848 A1 * 3/2021 Nocchi ..... G06V 10/44
2021/0094816 A1 * 4/2021 Tokunaga ..... G07F 9/006
2021/0225120 A1 * 7/2021 Levine ..... A23G 9/22
2021/0387845 A1 * 12/2021 Taylor ..... B67D 1/1236
2022/0172549 A1 * 6/2022 Chung ..... G06Q 20/3274
2022/0219964 A1 * 7/2022 Lee ..... B67D 1/0888
2022/0221212 A1 * 7/2022 Carr ..... F25C 5/22

FOREIGN PATENT DOCUMENTS

KR 200264493 Y1 6/2002
KR 20090075068 A 7/2009
KR 101859952 B1 5/2018
WO WO-2016120204 A1 * 8/2016 ..... A47J 31/4425

* cited by examiner

BEVERAGE-DISPENSING APPLIANCE HAVING A SIGNAL SHIELD

FIELD OF THE INVENTION

The present subject matter relates generally to beverage dispensers, and more particularly to beverage dispensers having features for blocking signals from a sensor near an outlet.

BACKGROUND OF THE INVENTION

In home, restaurant, and office settings, it is common for multiple individual users to enjoy a wide variety of beverages. Such beverages may be hot or cold, flat or carbonated, flavored or unflavored, etc. For instance, coffee, tea, soft-drinks, vitamin/electrolyte drinks, purified chilled water, or hot water may all be desirable at various points in time. In some cases, one or more beverages may be obtained (e.g., dispensed) from a dispenser on multi-use appliance, such as a refrigerator appliance or icemaker appliance. In other cases, one or more beverages may be obtained (e.g., dispensed) from a dispenser on a dedicated or free-standing appliance.

Regardless of the exact type of appliance, it may be useful to provide one or more features for precisely dispensing or filling a container with a specific volume of liquid (e.g., beverage), such as a predetermined or user-specified volume of liquid. Some such systems have been referred to as "auto-fill" dispensers or dispensing assemblies and may rely on, for example one or more ultrasonic sensors. In spite of the advantages of these systems, certain disadvantages exist. For instance, it can be difficult for some systems to consistently obtain accurate information regarding a container to be filled (e.g., beneath an outlet of the dispenser). Nearby objects, such as cups or containers, that are not directly beneath the outlet may reflect (e.g., ultrasonic) signals that are transmitted and received by a corresponding sensor. This may cause interference with the sensor's readings, which may in turn limit the accuracy of the system. Limiting interference may be difficult, however, especially if the appliance needs to accommodate a wide variety of container shapes or sizes (e.g., below an outlet of the dispensing assembly).

As a result, it would be useful to provide an appliance or assembly addressing one or more of the above issues. In particular, it may be advantageous to provide an appliance or assembly having one or more features for preventing interference with one or more signals (e.g., while permitting the appliance or assembly to accommodate a wide variety of containers).

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a beverage-dispensing appliance is provided. The beverage-dispensing appliance may include a cabinet, a liquid line, a liquid level sensor, and a signal shield. The cabinet may define a mutually-orthogonal vertical direction, lateral direction, and transverse direction. The cabinet may define a dispenser recess. The liquid line may be mounted to the cabinet and define a liquid outlet above the dispenser recess. The liquid level sensor may be mounted to the cabinet and directed at the dispenser recess. The signal shield may be movably mounted to the cabinet. The signal shield may be movable between a blocking position and a permissive position. The blocking position may laterally bound at least a portion of the dispenser recess. The permissive position may be transversely spaced apart from the dispenser recess to permit lateral access thereto.

In another exemplary aspect of the present disclosure, a beverage-dispensing appliance is provided. The beverage-dispensing appliance may include a cabinet, a liquid line, a liquid level sensor, a container tray, and a signal shield. The cabinet may define a mutually-orthogonal vertical direction, lateral direction, and transverse direction. The cabinet may define a dispenser recess. The liquid line may be mounted to the cabinet and define a liquid outlet above the dispenser recess. The liquid level sensor may be mounted to the cabinet above the dispenser recess. The container tray may be disposed directly beneath the liquid outlet. The signal shield may be movably mounted to the cabinet and laterally spaced apart from the liquid level sensor. The signal shield may extend along the vertical direction from a top shield end to a bottom shield end. The bottom shield end may be disposed below liquid level sensor. The signal shield may be movable between a blocking position and a permissive position. The blocking position may laterally bound at least a portion of the dispenser recess and locate a front shield end of the signal shield forward from the liquid level sensor. The permissive position may be transversely spaced apart from the dispenser recess and locate the front shield end of the signal shield rearward from the liquid level sensor.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
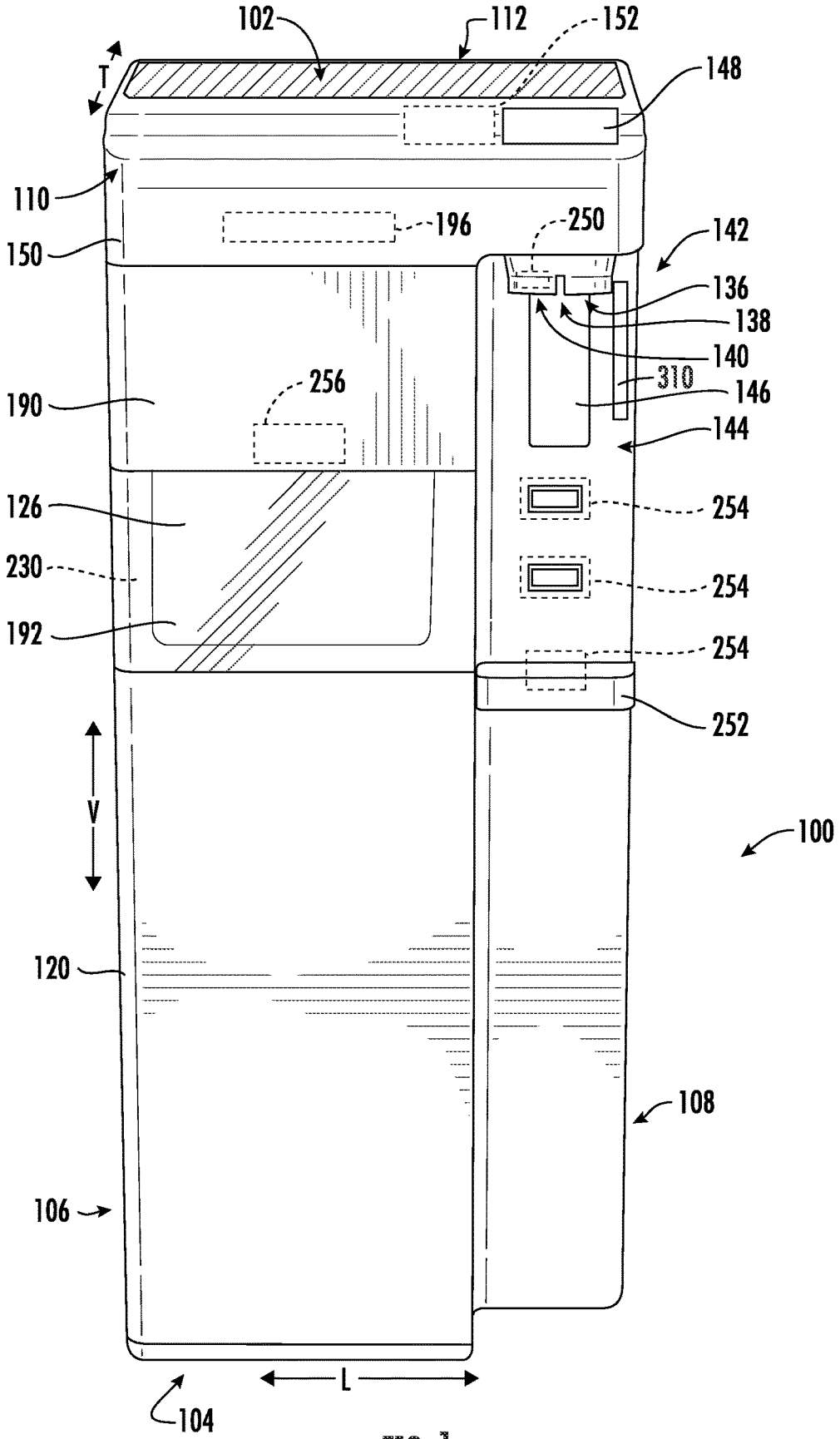
FIG. 1 provides a front perspective view of a beverage-dispensing appliance according to exemplary embodiments of the present disclosure.
Figure 2:
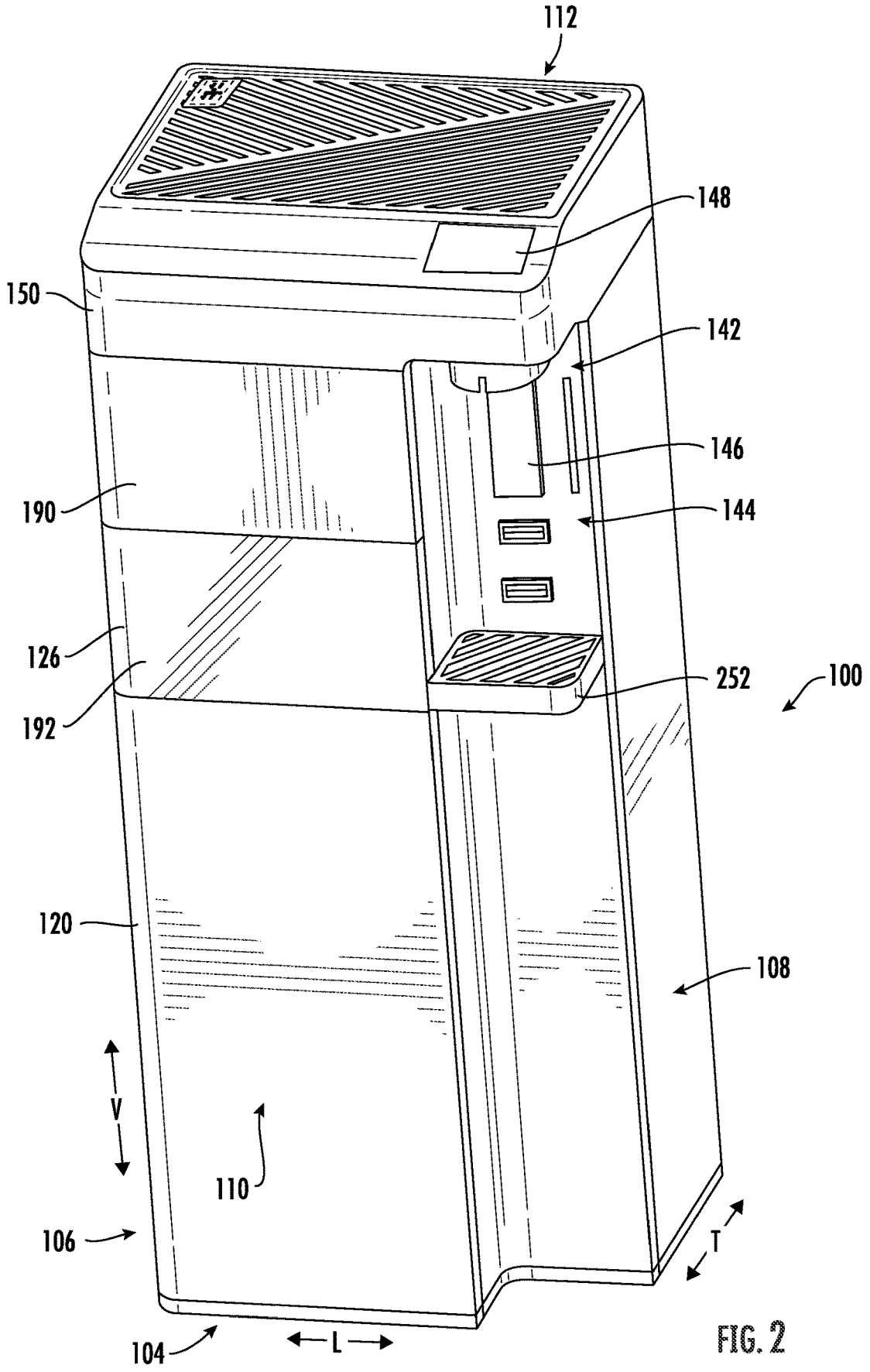
FIG. 2 provides a side perspective view of the exemplary beverage-dispensing appliance of FIG. 1.
Figure 3:
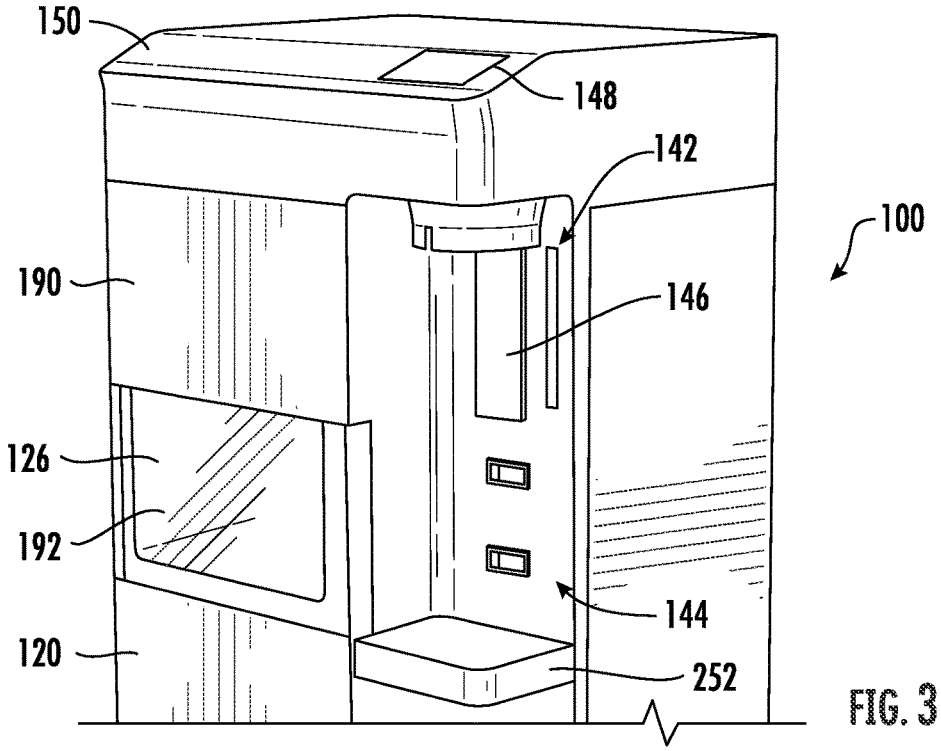
FIG. 3 provides a side perspective view of an upper portion of the exemplary beverage-dispensing appliance of FIG. 1.
Figure 4:
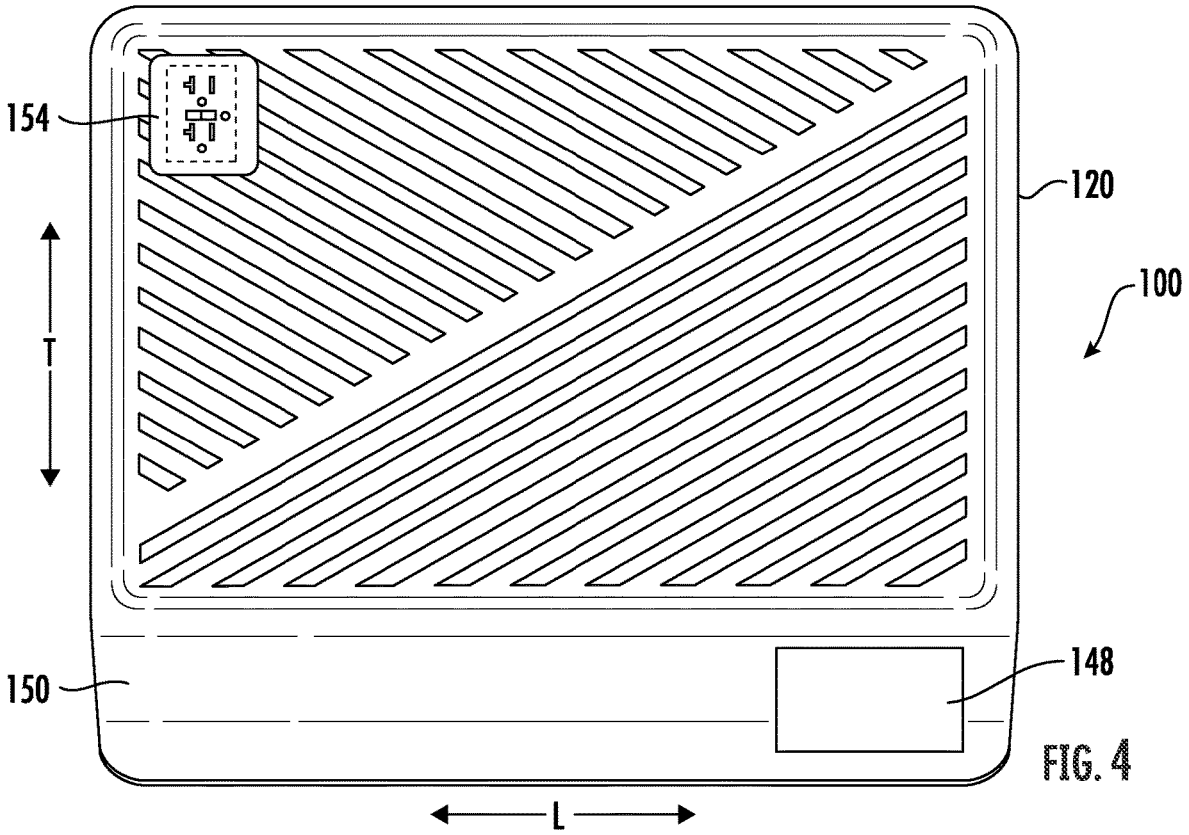
FIG. 4 provides a top plan view of the exemplary beverage-dispensing appliance of FIG. 1.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

Turning now to the figures, FIGS. 1 through 9 provide various views of a (e.g., free-standing) beverage-dispensing appliance 100, including certain portions thereof. Generally, beverage-dispensing appliance 100 includes a cabinet or housing 120 that extends between a top 102 and a bottom 104 along a vertical direction V; between a first side 106 and a second side 108 along a lateral direction L; and between a front 110 and a back 112 along a transverse direction T. Each of the vertical direction V, lateral direction L, and transverse direction T are mutually perpendicular and thus form an orthogonal direction system. In this regard, as used herein, the terms "cabinet," "housing," and the like are generally intended to refer to an outer frame or support structure for appliance 100, e.g., including any suitable number, type, and configuration of support structures formed from any suitable materials, such as a system of elongated support members, a plurality of interconnected panels, or some combination thereof. It should be appreciated that cabinet 120 does not necessarily require an enclosure and may simply include open structure supporting various elements of appliance 100. By contrast, cabinet 120 may enclose some or all portions of an interior of cabinet 120. It should be appreciated that cabinet 120 may have any suitable size, shape, and configuration while remaining within the scope of the present subject matter. Moreover, although shown as a free-standing assembly, it is understood that the present disclosure may be equally applicable to another suitable appliance or configuration (e.g., refrigerator appliance, plumbed beverage appliance, etc.).

As will be described in greater detail below, cabinet 120 supports or houses various components of beverage-dispensing appliance 100 to produce ice or dispense one more liquids (e.g., carbonated beverages) using a water source. Optionally, and to that end, beverage-dispensing appliance may include a refillable internal water tank 122 (e.g., removably held within cabinet 120). For instance, an icemaker 124 may be mounted within cabinet 120 downstream from water tank 122 to receive water therefrom and form ice, which may supplied to a downstream ice bin 126 disposed within the cabinet 120. Additionally or alternatively, one or more water lines (e.g., a cold water line 130, a hot water line 132, or a carbonated water line 134) may be mounted to (e.g., within) cabinet 120 downstream from water tank 122 to selectively dispense liquid(s) from one or more corresponding liquid outlets.

Beverage-dispensing appliance 100 includes a delivery assembly 142 for delivering or dispensing one or more liquids (e.g., from a liquid outlet, such as cold water outlet 136, hot water outlet 138, or carbonated water outlet 140). In some embodiments, a dispenser recess 144 is defined below one or more of the outlets 136, 138, 140. Additionally or alternatively, an actuating mechanism 146, shown as a paddle, may be mounted below the outlet(s) 136, 138, 140 (e.g., within dispenser recess 144) for operating delivery assembly 142. In alternative exemplary embodiments, any suitable actuating mechanism 146 may be used to operate delivery assembly 142. For example, delivery assembly 142 can include a sensor (such as an ultrasonic sensor) or a button rather than the paddle. In certain embodiments, a control panel 148 is provided (e.g., mounted to a top panel 150 of cabinet 120) for controlling the mode of operation. For example, control panel 148 may include a plurality of user inputs (not labeled), such as one or more buttons, knobs, or graphical user interfaces (e.g., presented on a touchscreen display) for selecting a desired mode of operation or beverage to be dispensed.

Operation of the beverage-dispensing appliance 100 can be regulated by a controller 152 that is operatively coupled to control panel 148 or various other components, as will be described below. Generally, in response to user manipulation of control panel 148 or one or more sensor signals, controller 152 may operate various components of the beverage-dispensing appliance 100. Controller 152 may include a memory and one or more microprocessors, CPUs or the like, such as general or special purpose microprocessors operable to execute programming instructions or micro-control code associated with operation of beverage-dispensing appliance 100. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 152 may be constructed without using a microprocessor (e.g., using a combination of discrete analog or digital logic circuitry; such as switches, amplifiers, integrators, comparators, flip-flops, AND gates, and the like) to perform control functionality instead of relying upon software.

Controller 152 may be positioned in a variety of locations throughout beverage-dispensing appliance 100. In the illustrated embodiments, controller 152 is located within top panel 150. In other embodiments, the controller 152 may be positioned at any suitable location within cabinet 120. Input/output ("I/O") signals may be routed between controller 152 and various operational components of beverage-dispensing appliance 100. For example, control panel 148 and delivery assembly 142 may be in communication with controller 152 via one or more signal lines or shared communication busses. Additionally or alternatively, controller 152 may be in communication with various other components of beverage-dispensing appliance 100. For example, various valves, switches, light sources, etc. may be actuatable based on commands from the controller 152. As discussed, control panel 148 may additionally be in communication with the controller 152. Thus, the various operations may occur based on user input or automatically through controller 152 instruction.

In optional embodiments, a power receptacle 154 having one or more electrical outlet plugs (e.g., standard 3-prong outlets) may be mounted to cabinet 120 (e.g., at top panel 150). An electrical device, such as a coffee grinder or phone charger, having a mating inlet plug may selectively connect and disconnect from power receptacle 154.

Although beverage-dispensing appliance 100 is not limited to any specific shape or dimensions, beverage-dispensing appliance 100 may generally be sized to fit within a fairly small room, such as an office breakroom, commercial kitchen, or in place of a so-called water cooler (i.e., fountain). Optionally, one or more casters or rollers 156 may be mounted to cabinet 120 (e.g., at the bottom 104) to support beverage-dispensing appliance 100 while permitting movement of the same.

Turning especially to FIGS. 1 and 7 through 9, icemaker 124 is provided downstream from the water tank 122 to receive water therefrom for ice making operations. Icemaker 124 may be provided as any suitable ice making assembly (e.g., for forming nugget ice, cubed ice, shaved ice, etc.). In certain embodiments, icemaker 124 includes or is provided as nugget icemaker, and in particular is an auger-style icemaker 124. Nonetheless, other suitable styles of icemakers are within the scope of the present disclosure.

As shown, icemaker 124 may include a casing 160 into which water from water tank 122 is flowed (e.g., directly from water tank 122 through one or more conduits or indirectly from water tank 122, such as through one or more intermediate storage volumes). For instance, water may be motivated by an inline pump 162 in fluid communication with water tank 122. In the illustrated embodiments, a primary line 164 from water tank 122 feeds to a downstream ice assembly line 166 (e.g., as directed by one or more valves 158, 212 or pump 162).

As would be understood, an auger may be disposed at least partially within the casing 160. During operation, the auger may rotate. Water within the casing 160 may at least partially freeze due to heat exchange, such as with a refrigeration system 172 as discussed herein. The at least partially frozen water may be lifted by the auger from casing 160. Further, in exemplary embodiments, the at least partially frozen water may be directed by the auger to and through an extruder 168. The extruder 168 may extrude the at least partially frozen water to form ice, such as nuggets of ice, as would be understood.

Formed ice may be provided by the icemaker 124 to ice bin 126 and may be received in the bin volume defined by ice bin 126. For example, ice formed by the auger or extruder 168 may be provided to the ice bin 126. In exemplary embodiments, a chute 170 may be included for directing ice produced by the icemaker 124 towards the bin volume defined by ice bin 126. For example, as shown, chute 170 is generally positioned above ice bin 126 along the vertical direction V. Thus, ice can slide off of chute 170 and drop into ice bin 126. Chute 170 may, as shown, extend between icemaker 124 and ice bin 126, and may define a passage therethrough. Ice may be directed from the icemaker 124 (such as from the auger or extruder 168) through the passage of chute 170 to the ice bin 126. In some embodiments, for example, a sweep, which may for example be connected to and rotate with the auger, may contact the ice emerging through the extruder 168 from the auger and direct the ice through the passage of chute 170 to the ice bin 126.

As discussed, water within the casing 160 may at least partially freeze due to heat exchange, such as with a refrigeration system 172. In exemplary embodiments, icemaker 124 may include a sealed system. The sealed refrigeration system 172 may be in thermal communication with the casing 160 to remove heat from the casing 160 and the interior volume thereof, thus facilitating freezing of water therein to form ice. Sealed refrigeration system 172 may, for example, include a compressor 174, a condenser 176, an expansion device 178, and an evaporator 180. Evaporator 180 may, for example, be in thermal communication with the casing 160 in order to remove heat from the casing 160 and water therein during operation of refrigeration system 172. For example, evaporator 180 may at least partially surround the casing 160. In particular, evaporator 180 may be a conduit coiled around and in contact with casing 160, such as the sidewall(s) thereof.

During operation of refrigeration system 172, refrigerant exits evaporator 180 as a fluid in the form of a superheated vapor or vapor mixture. Upon exiting evaporator 180, the refrigerant enters compressor 174 wherein the pressure and temperature of the refrigerant are increased such that the refrigerant becomes a superheated vapor. The superheated vapor from compressor 174 enters condenser 176 wherein energy is transferred therefrom and condenses into a saturated liquid or liquid vapor mixture. This fluid exits condenser 176 and travels through expansion device 178 that is configured for regulating a flow rate of refrigerant therethrough. Upon exiting expansion device 178, the pressure and temperature of the refrigerant drop at which time the refrigerant enters evaporator 180 and the cycle repeats itself. In certain exemplary embodiments, expansion device 178 may be a capillary tube or electronic expansion valve. Notably, in some embodiments, refrigeration system 172 may additionally include fans (not shown) for facilitating heat transfer to/from the condenser 176 or evaporator 180.

As noted above, ice may be received within the downstream ice bin 126. For instance, ice bin 126 may define a bin opening 182 (e.g., at the top end of ice bin 126) to permit ice therethrough. In some embodiments, a drain aperture 184 is defined at a bottom end of ice bin 126. For instance, drain aperture 184 may be defined through a base wall of ice bin 126 above a discrete melt water storage volume 186. Ice held within ice bin 126 may gradually melt. Drain aperture 184, may advantageously drain melt water away from ice bin 126. In some embodiments, one or more conduits may extend from the melt water storage volume 186 to the icemaker 124 or water tank 122. Thus, the melt water may be reused by beverage-dispensing appliance 100 to form ice. Optionally, one or more sanitizers 188 [e.g., ultraviolet (UV) light assembly or fluid filtration assembly] may be placed along the flow path from the melt water storage volume 186 to sanitize melt water before it is used to make ice or directed to another line within appliance 100.

In some embodiments, ice bin 126 is mounted (e.g., removably or fixedly) to cabinet 120 below top panel 150. A bin door 190 may be movably (e.g., rotatably or slidably) mounted on cabinet 120 to selectively permit access to the bin volume of ice bin 126. In the illustrated embodiments, bin door 190 is rotatably mounted to cabinet 120 above ice bin 126. Specifically, bin door 190 is disposed above bin opening 182 such that a user may selectively open bin door 190 and reach down to access ice within ice bin 126 though bin opening 182.

At least one wall (e.g., front sidewall 192) of ice bin 126 may be visible from outside cabinet 120. For instance, the front sidewall 192 may fit within a corresponding opening in an outer panel of cabinet 120. Additionally or alternatively, the front sidewall 192 may be formed from a clear, see-through (i.e., transparent or translucent) material, such as a clear glass or plastic, such that a user can see into the storage volume of ice bin 126 and thus view ice therein. One or more internal sidewalls 194 may extend from the front sidewall 192 and be spaced apart from an inner surface of cabinet 120.

In optional embodiments, a light source 196 is mounted within the cabinet 120. Generally, during operation, light source 196 may selectively emit or direct light into ice bin 126, illuminating any ice therein. Light source 196 may include a suitable light-emitting element, such as one or more fluorescent bulbs or light emitting diodes (LEDs). In exemplary embodiments, light source 196 is positioned above bin opening 182. For instance, light source 196 may be mounted to a bottom surface of top panel 150 above bin door 190. Along with illuminating ice bin 126 when bin door 190 is closed, light source 196 may provide illumination for a user when bin door 190 is open, such that a user can see the contents of ice bin 126.

Figure 6:
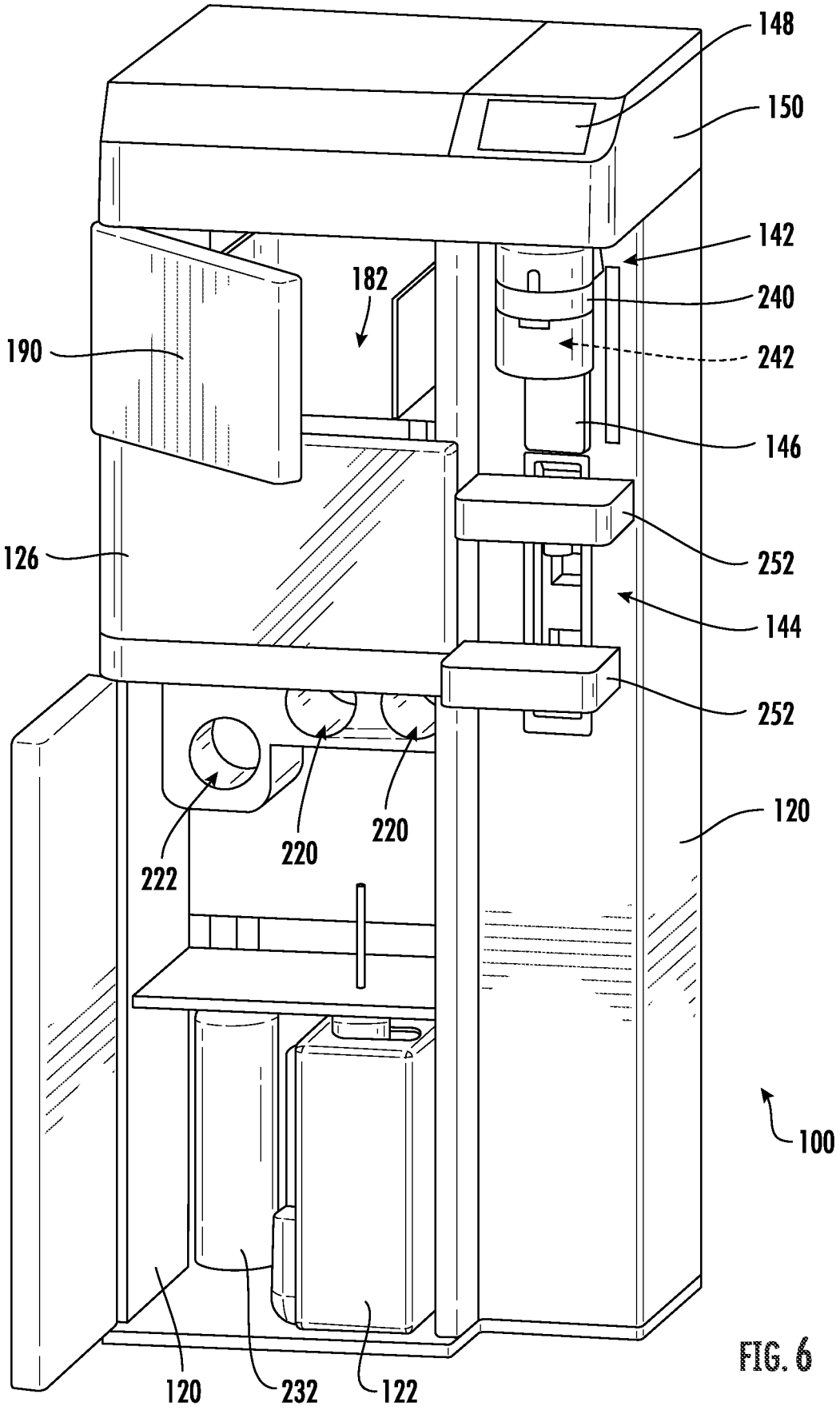
FIG. 6 provides a side perspective view of the exemplary beverage-dispensing appliance of FIG. 5, wherein multiple door have been opened for the purposes of clarity.
Figure 7:
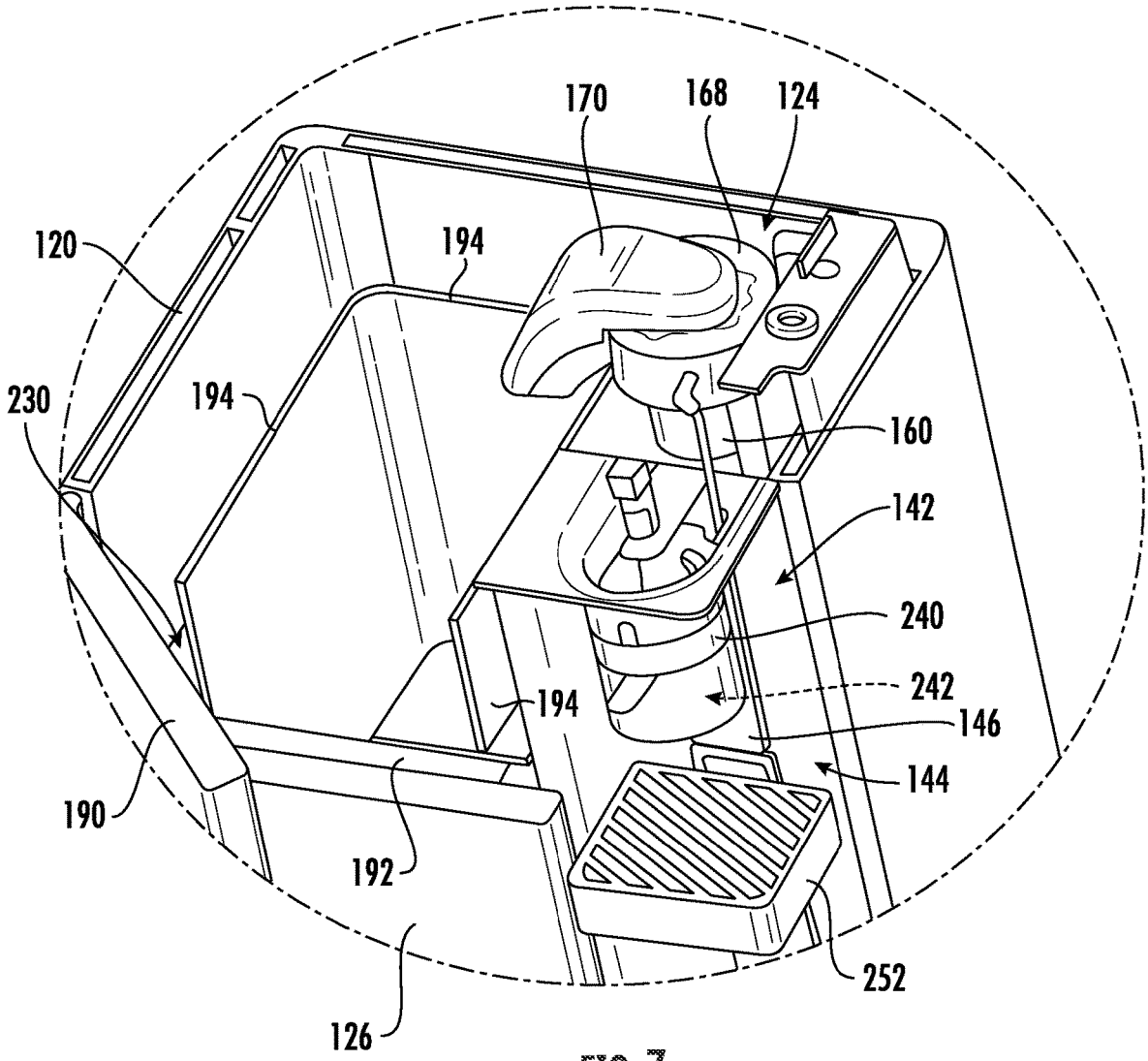
FIG. 7 provides a side perspective view of a top portion of the exemplary beverage-dispensing appliance of FIG. 6, wherein a top panel has been removed for the purposes of clarity.
Figure 8:
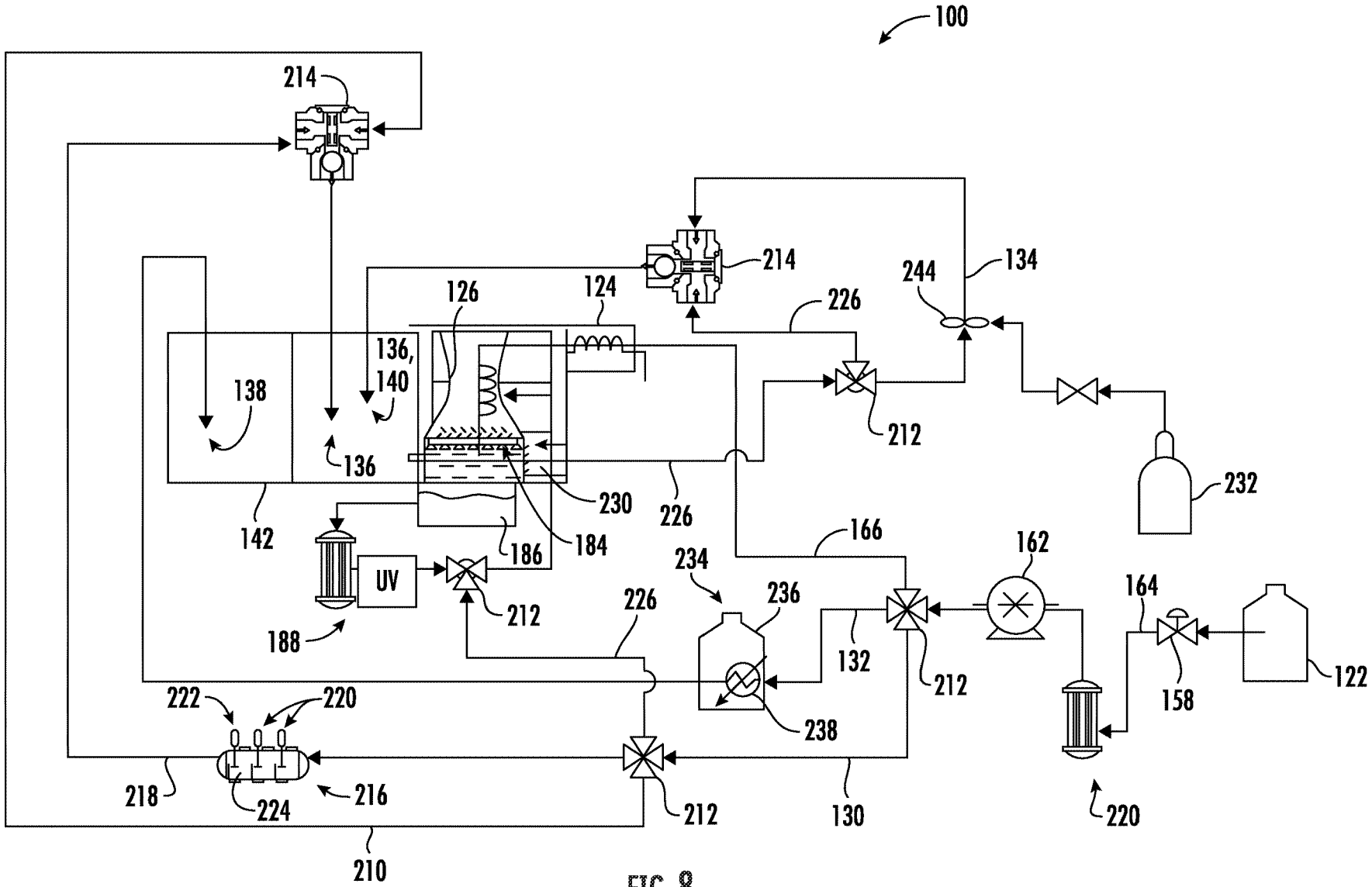
FIG. 8 provides a schematic view of the exemplary beverage-dispensing appliance of FIG. 1 illustrating the flow paths of fluids within the beverage-dispensing appliance.
Figure 9:
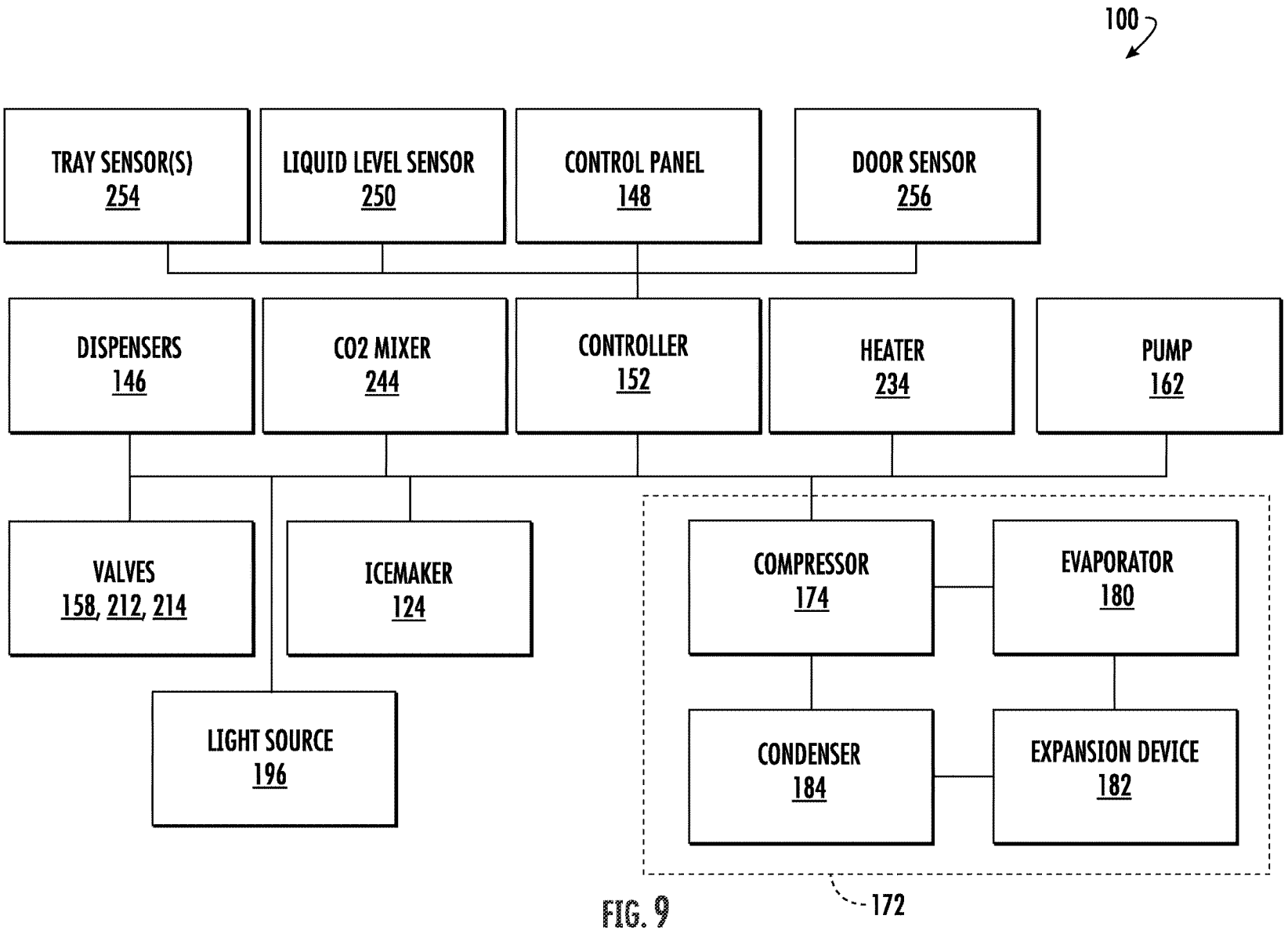
FIG. 9 provides a schematic view of the exemplary beverage-dispensing appliance of FIG. 1 illustrating various connections within the beverage-dispensing appliance.
Figure 10:
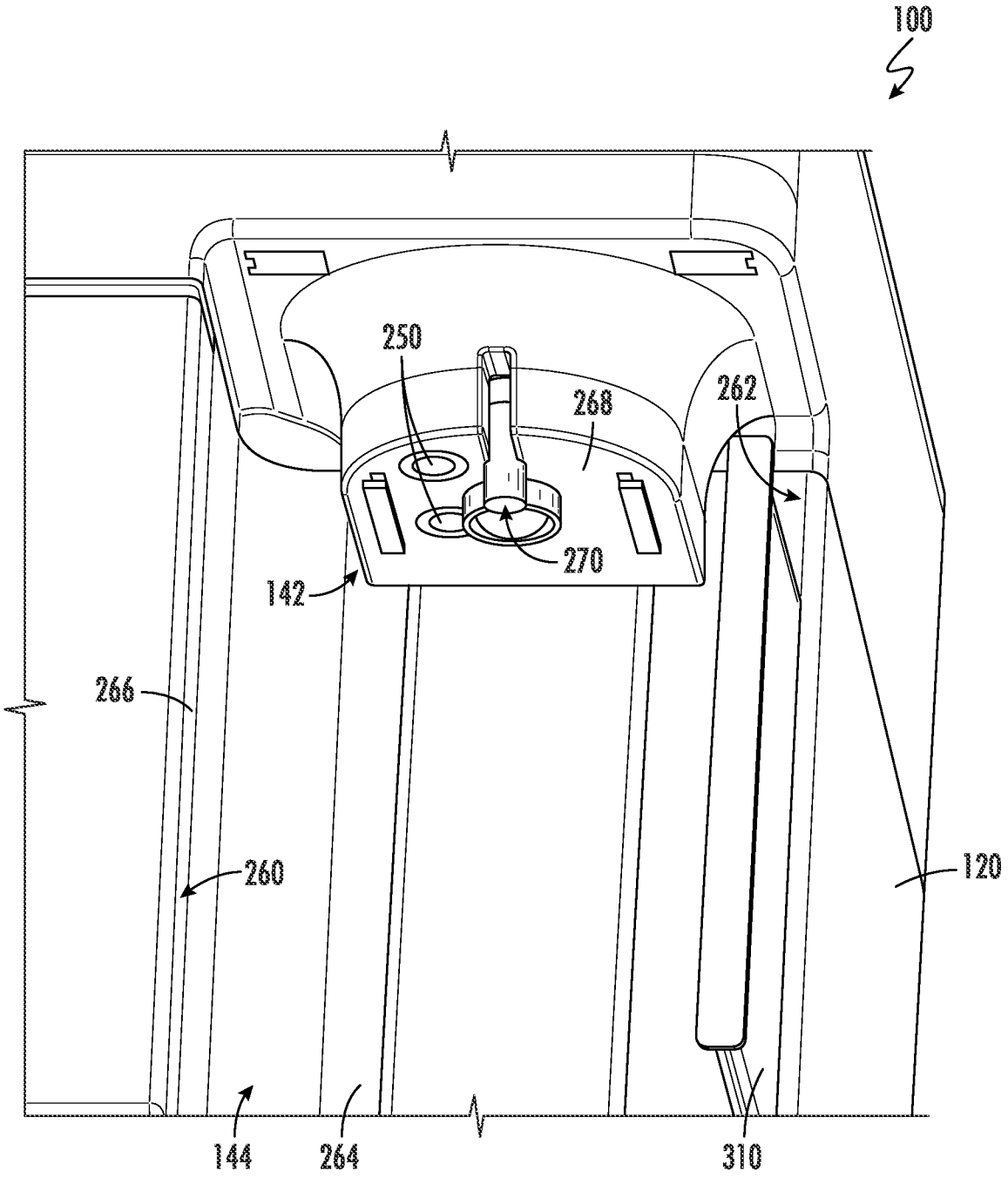
FIG. 10 provides a bottom perspective view of a delivery assembly of the exemplary beverage-dispensing appliance of FIG. 1.
Figure 11:
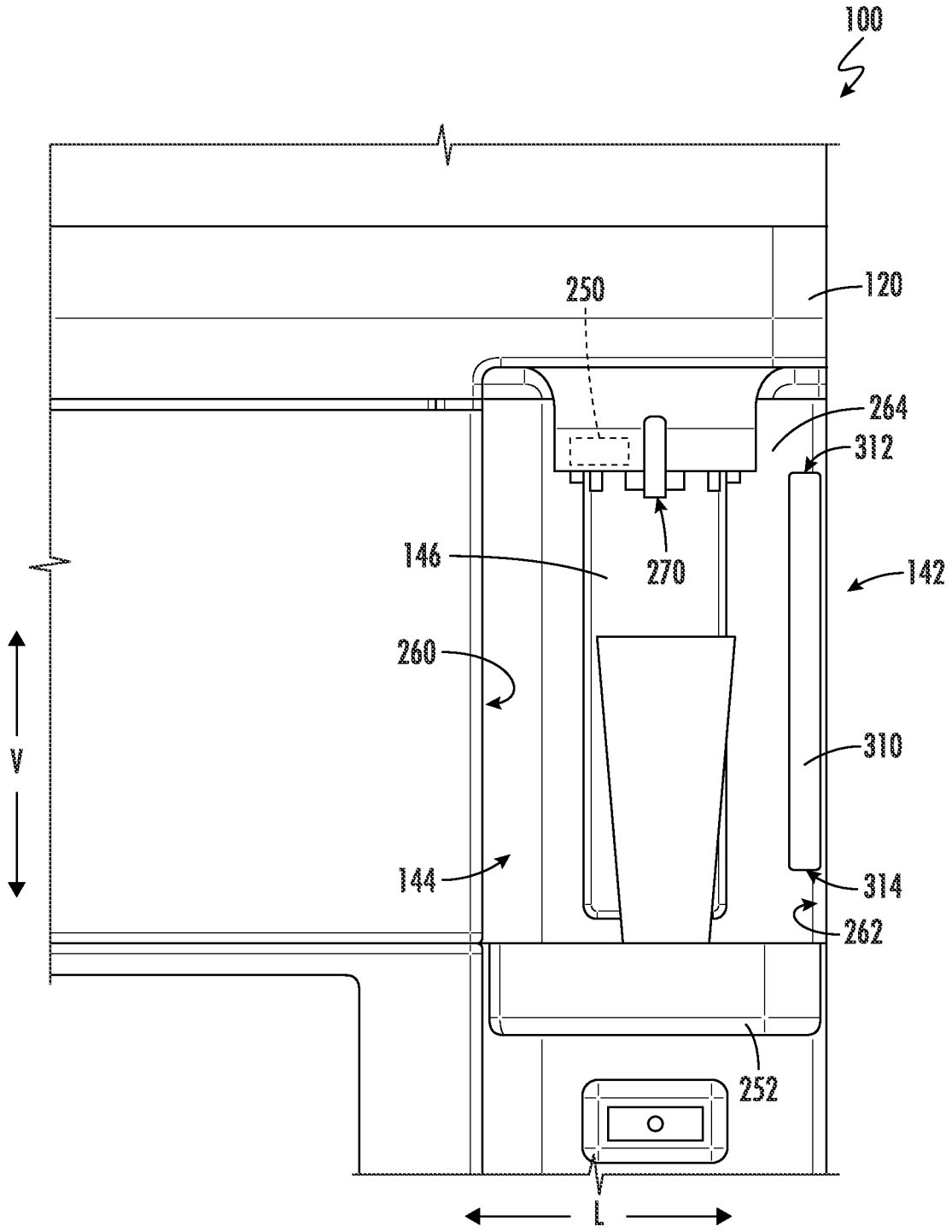
FIG. 11 provides a front elevation view of the delivery assembly of the exemplary beverage-dispensing appliance of FIG. 1.
Figure 12:
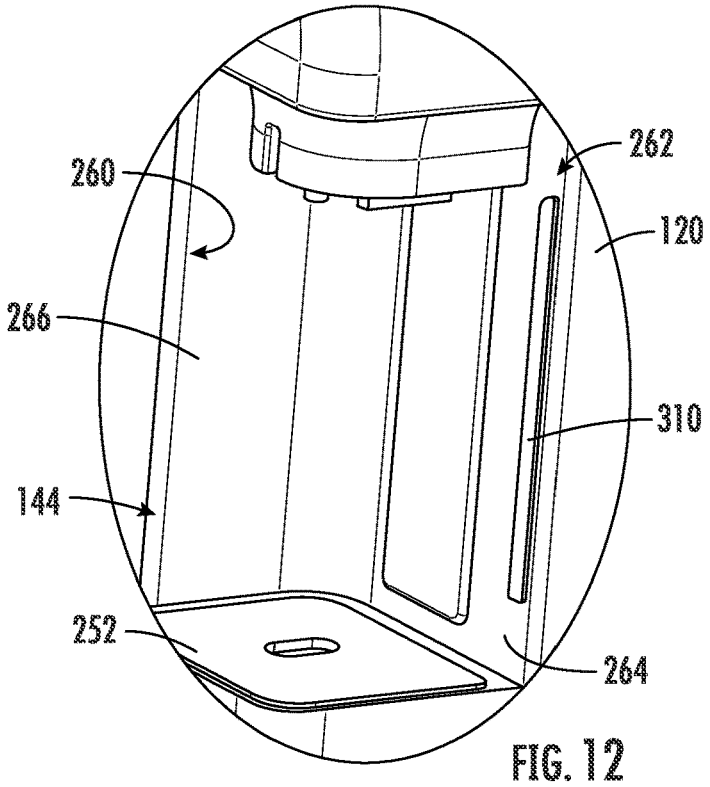
FIG. 12 provides a side perspective view of the delivery assembly of the exemplary beverage-dispensing appliance of FIG. 1, wherein a signal shield is in a permissive position.
Figure 13:
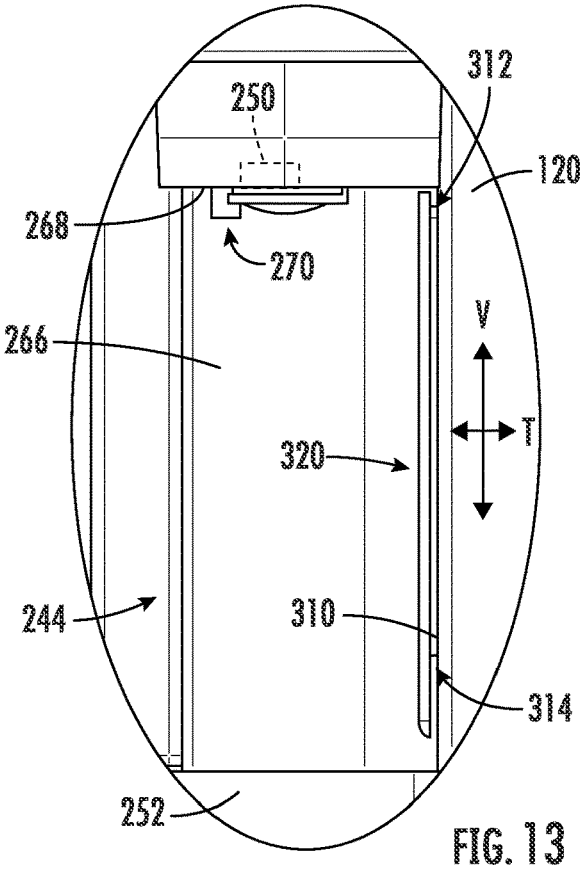
FIG. 13 provides a side elevation view of the delivery assembly of the exemplary beverage-dispensing appliance of FIG. 1, wherein the signal shield is in the permissive position.
Figure 14:
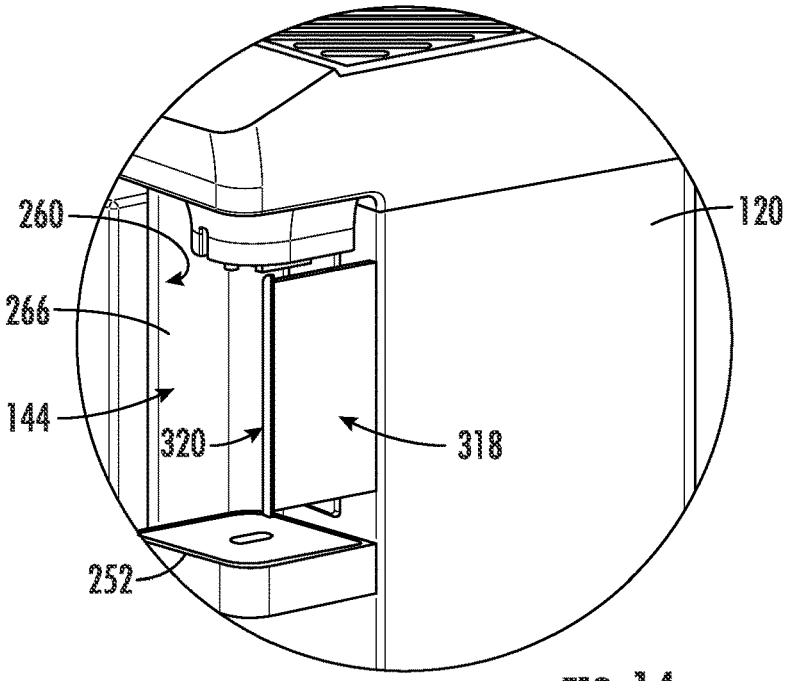
FIG. 14 provides a side perspective view of the delivery assembly of the exemplary beverage-dispensing appliance of FIG. 1, wherein the signal shield is in a blocking position.
Figure 15:
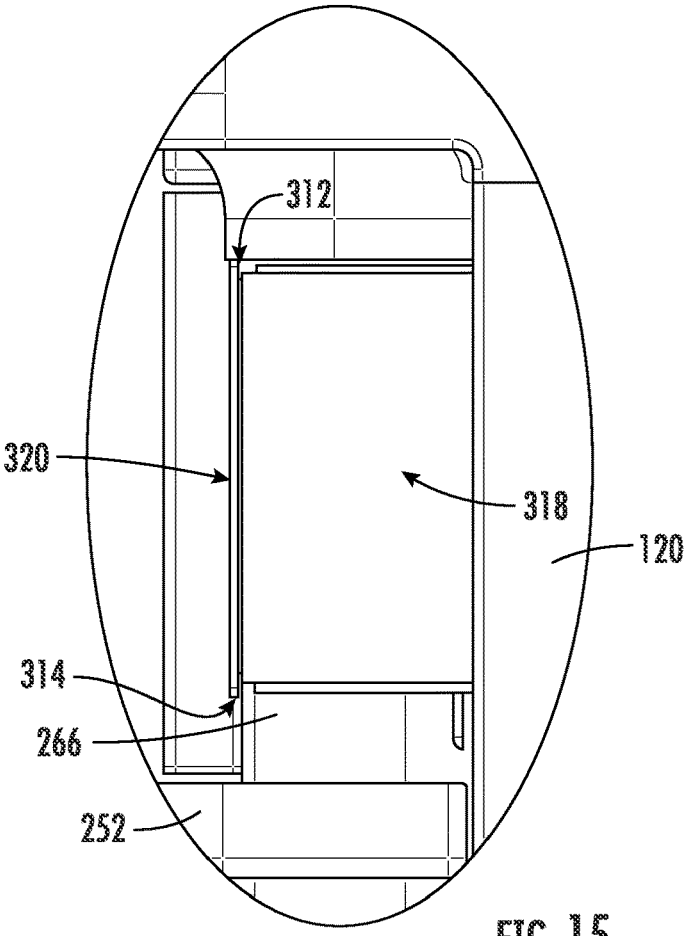
FIG. 15 provides a side elevation view of the delivery assembly of the exemplary beverage-dispensing appliance of FIG. 1, wherein the signal shield is in a blocking position.
Figure 16A:
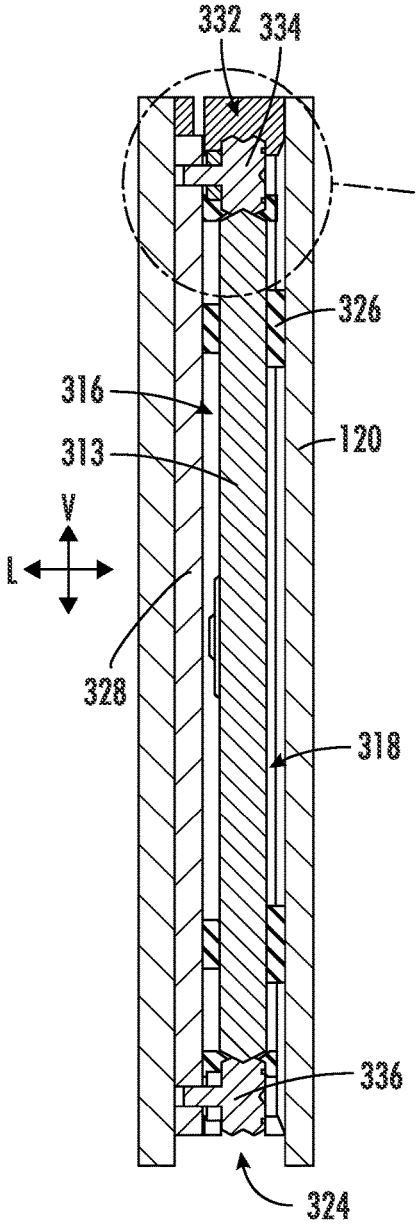
FIG. 16A provides a front sectional view of the signal shield of the exemplary beverage-dispensing appliance of FIG. 1.
Figure 16B:
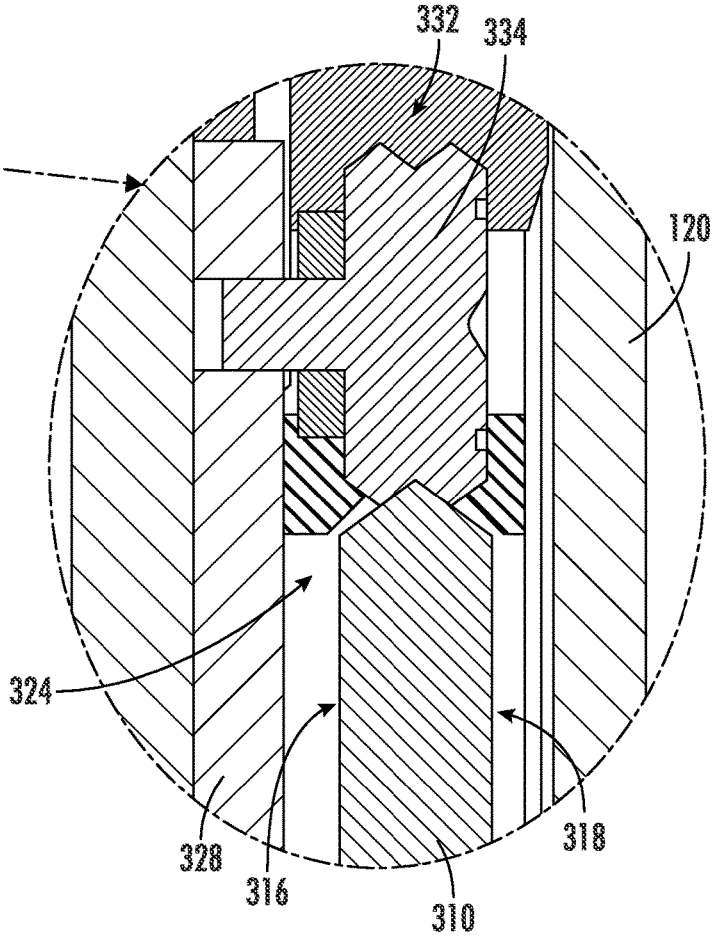
FIG. 16B provides a magnified, front, sectional view of a portion of the exemplary signal shield of FIG. 16A.
Figure 17A:
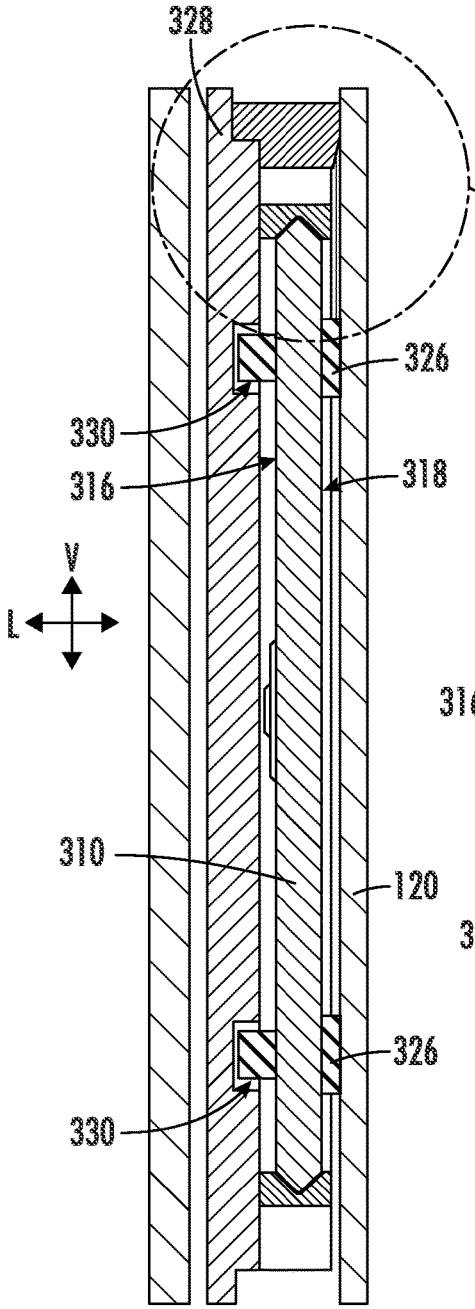
FIG. 17A provides another front sectional view of the signal shield of the exemplary beverage-dispensing appliance of FIG. 1.
Figure 17B:
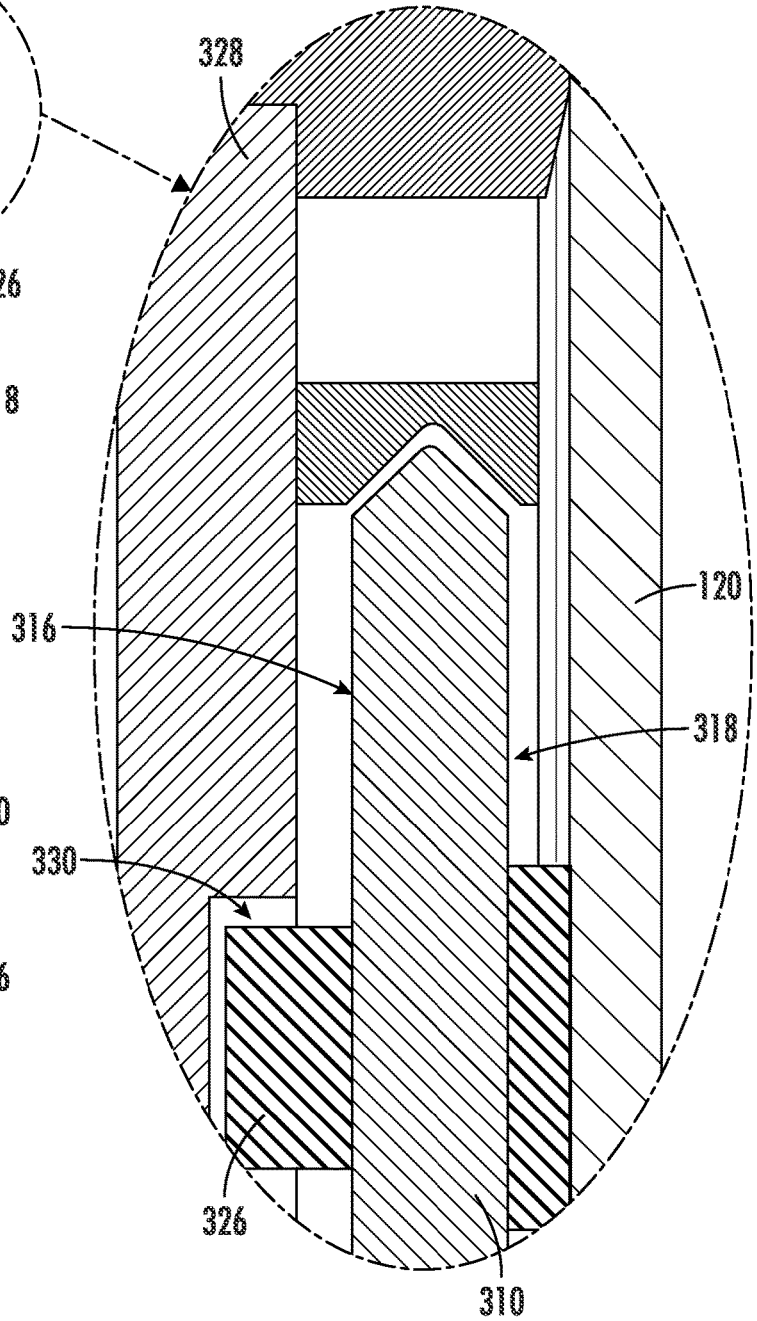
FIG. 17B provides another magnified, front, sectional view of a portion of the exemplary signal shield of FIG. 17A.
Figure 18:
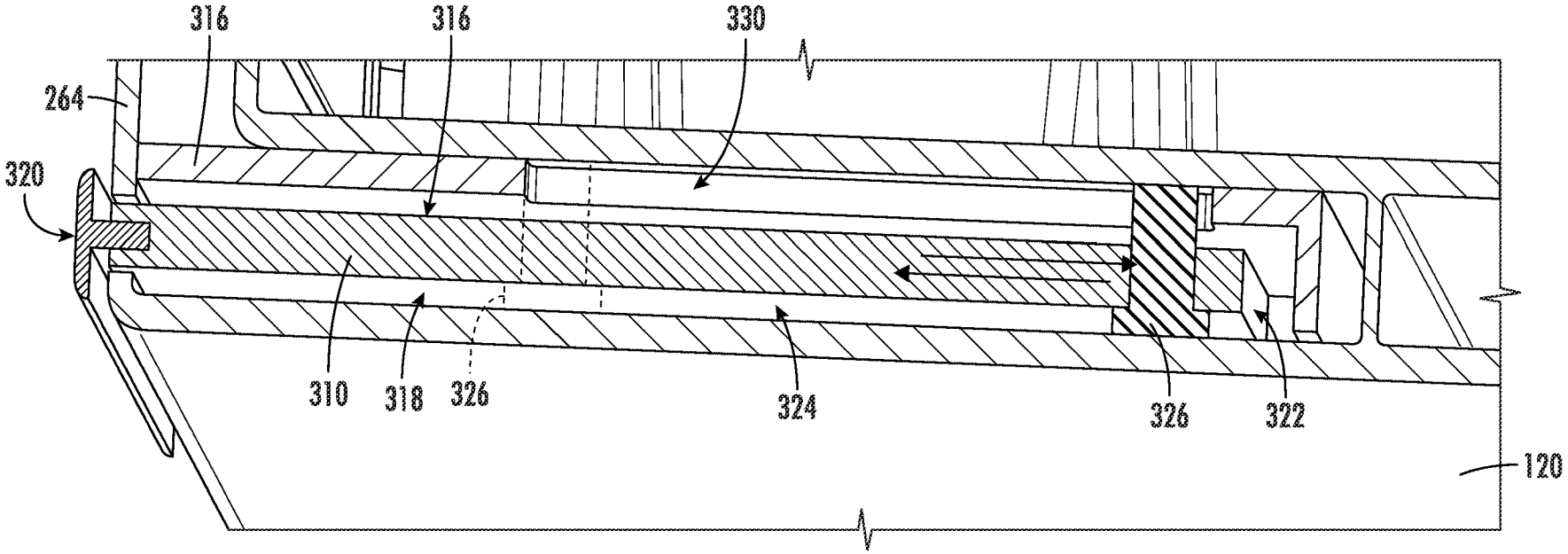
FIG. 18 provides a cross-sectional perspective view of the signal shield within the cabinet of the exemplary beverage-dispensing appliance of FIG. 1.

Turning especially now to FIGS. 1, 6, and 8, one or more cold water lines 130 are provided within cabinet 120. For instance, from primary line 164, cold water line 130 may extend (e.g., along one or more parallel or connected branches) to one or more cold water outlets 136 disposed at dispenser. As shown, an untreated branch 210 of cold water line 130 may extend from a multi-path valve 212 to an outlet port 214 defining a cold water outlet 136 above dispenser recess 144. Water flowing from water tank 122 to cold water line 130 may be directed by one or more valves 158, 212 or pump 162.

In certain embodiments, a water treatment assembly 216 is provided along cold water line 130. Generally, water treatment assembly 216 may provide one or more units for filtering out or incorporating in one or more elements into water through cold water line 130. Such units may be provided in stages along a treated branch 218 of cold water line 130 (e.g., downstream of a multi-path valve 212) upstream of outlet port 214 defining a cold water outlet 136. For instance, water treatment assembly 216 may include one or more filtration stages 220 containing a filtration media (e.g., a paper filter cartridge, activated carbon, a mixed-bed media of commingled anion and cation resin, etc.). Additionally or alternatively, one or more additive stages 222 containing a water additive (e.g., electrolyte solute or mixture, flavor syrup, pH adjuster or alkaline additive, etc.) may be provided. In particular, an additive cartridge 224 holding the water additive may be selectively disposed on or received at additive stage 22. Thus, as water is flowed through at least a portion of cold water line 130 (e.g., treated branch 218), such water may be filtered or intermixed with a water additive prior to being dispensed (e.g., from a cold water outlet 136). Optionally, treated water may further mix with untreated water prior to being dispensed. For instance, untreated branch 210 and treated branch 218 may terminate at a common outlet port 214 upstream of a cold water outlet 136.

In additional or alternative embodiments, at least a portion of cold water line 130 may be chilled (e.g., to draw heat from or otherwise cool water within that portion of cold water line 130). For instance, a chilled branch 226 of cold water line 130 may be provided upstream of a corresponding cold water outlet 136 (e.g., downstream of a multi-path valve 212).

Generally, a passive or active chiller is provided along chilled branch 226. In some embodiments, a cooling jacket 230 is provided as a passive chiller to cool water within chilled branch 226. Specifically, cooling jacket 230 may define at least a portion of chilled branch 226. Moreover, cooling jacket 230 may extend along at least a portion of ice bin 126. In some such embodiments, cooling jacket 230 is disposed between one or more internal sidewalls 194 of ice bin 126 and an inner surface of cabinet 120. Specifically, cooling jacket 230 may be in conductive thermal communication with ice bin 126. Thus, heat from cooling jacket 230 (e.g., water therein) may gradually be conducted to ice bin 126 such that ice within ice bin 126 is able to cool water within cooling jacket 230. Optionally, one or more valves (e.g., multi-path valves 212) are disposed upstream from cooling jacket 230 such that a predefined volume of water may generally be held within cooling jacket 230 to ensure a steady supply of chilled water (e.g., at a cold water outlet 136).

In further additional or alternative embodiments, a carbonated water line 134 is provided downstream from water tank 122. Specifically, carbonated water line 134 may be provided in fluid isolation from a hot water line 132. In some embodiments, carbonated water line 134 is downstream of cold water line 130 (e.g., at chilled branch 226). Optionally, carbonated water line 134 terminates at an outlet port 214 defining a cold water or carbonated water outlet 140. In certain embodiments, the carbonated water outlet 140 is in fluid isolation from at least one cold water outlet 136 (e.g., even though it may alternately serve as a separate cold water outlet 136). For instance, chilled branch 226 and carbonated water line 134 may terminate at a common outlet port 214 that defines or is upstream of a cold and carbonated water outlet 136, 140.

Generally, a carbon dioxide tank 232 (e.g., mounted within cabinet 120) is disposed in selective communication with carbonated water line 134 to carbonate at least a portion of the water therein. For instance, as would be understood, a $CO_2$ mixer 244 downstream from carbon dioxide tank 232 may be selectively activated to carbonate water prior to being dispensed. Although illustrated as an in-line carbonation assembly, it is noted that a batch carbonation assembly may be provided, as would be understood.

Turning especially now to FIGS. 1 and 5 through 9, in addition to cold water line 130, one or more hot water lines 132 may be provided within cabinet 120. For instance, from primary line 164, hot water line 132 may extend to one or more hot water outlets 138 disposed at delivery assembly 142. As shown, although hot water line 132 and cold water line 130 may both be downstream from water tank 122, hot water outlet 138 may be in fluid isolation from each cold water outlet 136. Water flow from water tank 122 to hot water line 132 may be directed by one or more valves 158, 212 or pump 162.

Generally, a heating element or heater 234 is provided along the hot water line 132 to selectively heat water upstream from hot water outlet 138. In some embodiments, a heater tank 236 is disposed within cabinet 120 upstream from hot water outlet 138 (e.g., along hot water line 132). Heater tank 236 may generally define an enlarged volume that is less than that of water tank 122. Thus, a suitable volume of hot water may be held or maintained within heater tank 236. In some embodiments, heater 234 is provided as or includes an electric heater element 238 (e.g., resistive heating wire, resistive thermal element, such as a CAL-ROD®, an inductive heating element, etc.) mounted within heater tank 236 (e.g., to selectively heat the water therein). During use, electric heater element 238 may thus be selectively activated (e.g., by controller 152) to generate or maintain a volume of water between, for instance, 160° Fahrenheit and 210° Fahrenheit.

In some embodiments, a brew module 240 is provided to aid in the generation or dispensing of one or more hot beverages. For instance, brew module 240 may define a brew chamber 242 in which a brew pod (e.g., sealed, disposable cup, or reusable mesh cup) may be received downstream from hot water outlet 138. In some embodiments, brew module 240 is mountable within dispenser recess 144 such that brew module 240 can be in fluid communication with hot water outlet 138 when mounted within dispenser recess 144. For example, when brew module 240 is installed on delivery assembly 142, an inlet of the brew module 240 may receive a water delivery tube to receive heated water therethrough. During use, heated water from the heater tank 236 may thus flow into the brew chamber 242. Within brew module 240, heated water may mix with, dissolve, or extract portions of a particulate material (e.g., held in a brew pod) to form a liquid beverage (e.g., a liquid coffee or tea solution), which may then exit brew module 240 through an outlet defined through brew module 240.

Turning now especially to FIGS. 1, 3, 5, and 6, beverage-dispensing appliance 100 may further include a liquid level sensor 250 to detect a volume or level of liquid (e.g., hot water, cold water, carbonated water, or another beverage) that is dispensed to or held within a cup or container below cold water outlet 136, hot water outlet 138, or carbonated water outlet 140. Generally, liquid level sensor 250 may be directed at dispenser recess 144. Specifically, liquid level sensor 250 may be mounted adjacent to dispenser recess 144. In some embodiments, liquid level sensor 250 is mounted above the dispenser recess 144 to detect a height of liquid dispensed to a container from the cold water outlet 136. For instance, liquid level sensor 250 may be in communication with controller 152 and operable to measure the height of a liquid within the corresponding container.

Liquid level sensor 250 can be any suitable device for detecting or measuring distance to an object. For example, liquid level sensor 250 may be an ultrasonic sensor, an infrared sensor, or a laser range sensor. In some such embodiments, liquid level sensor 250 may thus transmit an energy wave that can then be reflected and returned to liquid level sensor 250. Moreover, controller 152 can receive a signal, such as a voltage or a current, from liquid level sensor 250 that corresponds to the detected presence of or distance to a liquid within the corresponding container. Based on the received signal, controller 152 can initiate or direct an auto-fill sequence. Specifically, controller 152 can determine the height of dispensed liquids within a corresponding container to ensure a predetermined level or dispensed volume is provided to the corresponding container.

Figure 5:
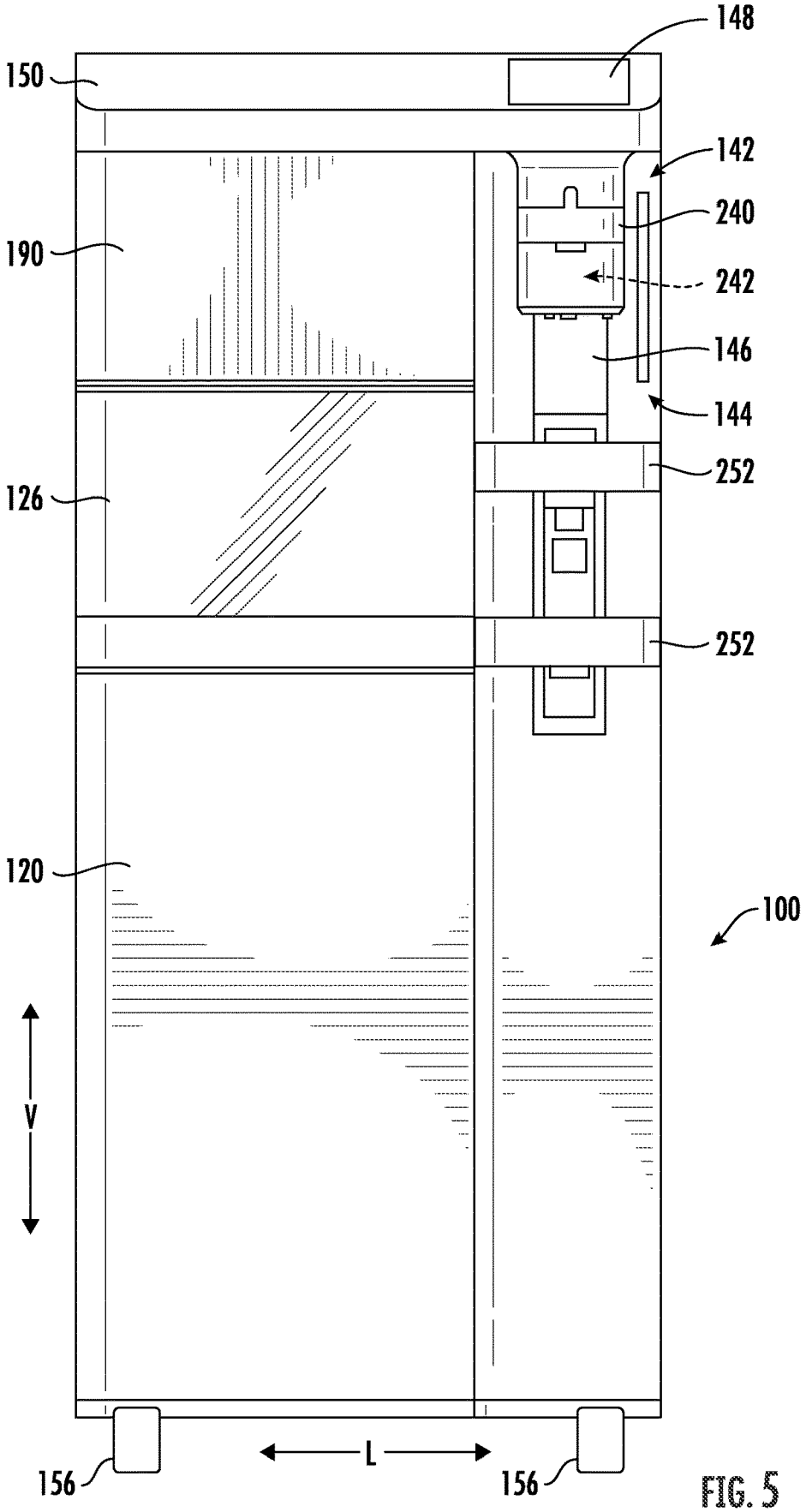
FIG. 5 provides an elevation view of the exemplary beverage-dispensing appliance of FIG. 1, wherein a removable brew module, additional tray, and roller set have been illustrated for the purposes of clarity.

In optional embodiments, liquid level sensor 250 can work in tandem with one or more other sensors to control the auto-fill sequence. As an example, in certain embodiments, a movable container tray 252 is provided to support a container below delivery assembly 142 (for the purposes of illustration, two trays 252 are shown in FIGS. 5 and 6).

Movable container tray 252 may be selectively mounted to cabinet 120 at a plurality of predetermined discrete heights along the vertical direction V. For instance, each discrete height may provide or define a separate receiving index (e.g., post, recess, clip, etc.) on which movable container tray 252 may be mounted. At each discrete height a separate fixed tray sensor 254 (e.g., reed switch, Hall effect sensor, pressor sensor, etc.) may be provided to detect the presence of movable container tray 252. In some such embodiments, controller 152 may be configured to receive a signal from the fixed tray sensor 254 at which movable container tray 252 is mounted, and further direct the auto-fill sequence based on the same. For instance, controller 152 may the use the tray sensor signal to detect a distance between the movable container tray 252 and the liquid level sensor 250, and thus estimate a base height of the container that is to be filled.

As an additional or alternative example, one or more sensors may be provided to selectively halt or prevent an auto-fill sequence from proceeding. In some such embodiments, a door sensor 256 is mounted to cabinet 120 in selectively engagement with door. For instance, door sensor 256 may generally detect when bin door 190 is moved away from the closed position and transmit/halt a signal to controller 152 in response to the same. To that end, door sensor 256 may include any suitable physical detection sensor (e.g., reed switch, Hall effect sensor, pressor sensor, etc.) to selectively engage with bin door 190 in the closed position. In response to placement of the bin door 190 away from the closed position, door sensor 256 may thus transmit a door ajar signal to the controller 152. In response to receiving the door ajar signal, the controller 152 is may halt or prevent the auto-fill sequence.

Advantageously, beverage-dispensing appliance 100 may supply and dispense multiple types of beverages within a relatively small or unplumbed assembly.

Turning now to FIGS. 10 through 21, various views are provided of delivery assembly 142, including portions thereof. As noted above, a dispenser recess 144 is defined by cabinet 120 below one or more liquid lines (e.g., 130, 132, 134) defining at least one liquid outlet 270 (e.g., 136, 138, 140). Moreover, as will be described in greater detail below, a signal shield 310 may be provided by or adjacent to dispenser recess 144.

As shown, dispenser recess 144 may be formed by one or more external panels or walls of cabinet 120. For instance, cabinet 120 may form a negative cavity that is generally open along a horizontal direction (e.g., the transverse direction T or the lateral direction L) to receive a container therein. If open along the transverse direction T, dispenser recess 144 may extend along the lateral direction L between a first recess side 260 and a second recess side 262. The transverse opening to dispenser recess 144 may thus be defined between first recess side 260 and second recess side 262. A back wall 264 may by disposed or extend between first recess side 260 and second recess side 262 (e.g., as well as vertically). Additionally or alternatively, a static side wall 266 may be disposed at first recess side 260 or second recess side 262. Further additionally or alternatively, an upper recess wall 268 may be disposed at an upper end of dispenser recess 144.

As shown, static side wall 266 may fixedly bound or partially define dispenser recess 144 (e.g., at a lateral extreme of dispenser recess 144). Optionally, static side wall 266 may further extend vertically or generally parallel to the vertical direction V. In certain embodiments, dispenser recess 144 is defined by a generally L-shaped panel including back wall 264 and static side wall 266 (e.g., at first recess side 260). In turn, dispenser recess 144 may be open along the transverse direction T (e.g., at a front end of dispenser recess 144 opposite of back wall 264) and open along the lateral direction L (e.g., at the second recess side 262 opposite of static side wall 266).

In some embodiments, upper recess wall 268 is disposed between first recess side 260 and second recess side 262. Separate from or in addition to static side wall 266 or back wall 264, upper recess wall 268 may fixedly bound or partially define dispenser recess 144 (e.g., at a vertical extreme of dispenser recess 144). Optionally, upper recess wall 268 may further extend horizontally or generally perpendicular to the vertical direction V. As shown, container tray 252 may be selectively disposed directly beneath upper recess wall 268. At least one liquid outlet 270 (e.g., 136, 138, 140) may be defined by or held through upper recess wall 268. Together, upper recess wall 268 and container tray 252 may thus effectively define a useable height or vertical length for dispenser recess 144. Optionally, dispenser recess 144 may be vertically open below upper recess wall 268 and, thus, extend to the floor or surface on which cabinet 120 is supported.

As noted above, liquid level sensor 250 may be mounted to cabinet 120 (e.g., above dispenser recess 144). In some embodiments, liquid level sensor 250 is mounted on upper recess wall 268. Optionally, liquid level sensor 250 is horizontally spaced apart from one or more liquid outlets 270 (e.g., 138, 140, 142). Additionally or alternatively, liquid level sensor 250 may be disposed above container tray 252 (e.g., when container tray 252 is received within dispenser recess 144). Thus, container tray 252 may be selectively disposed directly beneath liquid level sensor 250, as shown.

In some embodiments, a movable signal shield 310 selectively and advantageously serves to block or absorb one or more energy waves or signals transmitted from liquid level sensor 250 (e.g., laterally), which might otherwise be received or reflected by items adjacent to appliance 100. As shown, when assembled, signal shield 310 generally extends along the vertical direction V from a top shield end 312 to a bottom shield end 314. Along one horizontal direction (e.g., the lateral direction L) signal shield 310 may further extend between an interior face 316 (e.g., directed toward dispenser recess 144) and an exterior face 318 (e.g., directed away from dispenser recess 144). Along another horizontal direction (e.g., the transverse direction T) signal shield 310 may further extend between a front shield end 320 and a rear shield end 322. Generally, signal shield 310 may be formed as or include solid or nonpermeable panel such that energy waves or signals from liquid level sensor 250 are prevented from passing through signal shield 310.

In the illustrated embodiments, a signal shield 310 is movably mounted to cabinet 120 near or adjacent to dispenser recess 144. Specifically, signal shield 310 may be spaced apart from liquid level sensor 250 (e.g., laterally). For instance, signal shield 310 may be generally disposed on one side (e.g., second recess side 262) of dispenser recess 144. In some such embodiments, signal shield 310 is disposed opposite of the static side wall 266. Although signal shield 310 may be movable relative to cabinet 120 or liquid level sensor 250, bottom shield end 314 may generally be located below (e.g., at a lower vertical height than) liquid level sensor 250.

As illustrated in FIGS. 10 through 21, signal shield 310 may be movably mounted to selectively move between a blocking position (e.g., FIGS. 14, 15, 19, and 21) and a permissive position (e.g., FIGS. 12, 13, 18, and 20). Generally, the blocking position provides signal shield 310 at a relatively forward position while permissive position provides signal shield 310 at a relatively rearward position.

In the blocking position, signal shield 310 is able to laterally bound at least a portion of dispenser recess 144. For instance, interior face 316 may define a lateral extreme of dispenser recess 144. Optionally, interior face 316 may be held parallel to the static side wall 266. In some embodiments, the blocking position partially reshapes or further encloses dispenser recess 144, such as in a U-shaped profile (e.g., when viewed in a horizontal plane). Relative to a horizontal direction, such as the transverse direction T, front shield end 320 may be disposed forward from liquid level sensor 250. In other words, as measured along the transverse direction T, liquid level sensor 250 may be disposed closer to back wall 264 than front shield end 320. Relative to the vertical direction V, top shield end 312 may be disposed at a height that is either higher than that of liquid level sensor 250 (e.g., the bottommost edge thereof) or approximately the same as the height of liquid level sensor 250 (e.g., the bottommost edge thereof). In turn, energy waves or signals (e.g., ultrasonic waves, light waves, etc.) transmitted from liquid level sensor 250 may advantageously be prevented from traveling (e.g., laterally) through signal shield 310. Optionally, container tray 252 may extend horizontally farther than at least a portion of signal shield 310 (e.g., at interior face 316). For instance, a lateral extreme of container tray 252 may be disposed farther from static side wall 266 (or first recess side 260 generally) than interior face 316 along the lateral direction L. Additionally or alternatively, container tray 252 may be disposed below bottom shield end 314. For instance, an uppermost surface of container tray 252 may be at a lower height than that of bottom shield end 314. Thus, signal shield 310 may notably avoid interference with mounting or movement of container tray 252. In some such embodiments, a vertical gap may be defined between the uppermost surface of container tray 252 (e.g., the height at which the uppermost surface of container tray 252 is disposed) and bottom shield end 314 (e.g., the height at which the bottom shield end 314 is disposed). Such a vertical gap may be less than or equal to 1 inch along the vertical direction V, notably focusing transmitted signals to a container on container tray 252.

In the permissive position, signal shield 310 may be transversely spaced apart from the dispenser recess 144 (e.g., rearward therefrom). Thus, in contrast to blocking position, at least a portion of dispenser recess 144 may be unbounded or open (e.g., along the lateral direction L). Relative to a horizontal direction, such as the transverse direction T, front shield end 320 may be located closer to cabinet 120 (e.g., at back wall 264) than front shield end 320 is in the blocking position. Optionally, front shield end 320 may be disposed rearward from liquid level sensor 250. In other words, as measured along the transverse direction T, liquid level sensor 250 may be disposed farther from back wall 264 than front shield end 320.

In exemplary embodiments, such as those shown in FIGS. 10 through 21, signal shield 310 is slidably mounted on the cabinet 120. When assembled, signal shield 310 may thus slide, for example, horizontally (e.g., along the transverse direction T) between the blocking position and the permissive position. In certain embodiments, the sliding motion may be a parallel translation. As signal shield 310 moves along the transverse direction T, top shield end 312 and bottom shield end 314 may maintain their respective vertical positions or heights. Front shield end 320 in the blocking position may be parallel to front shield end 320 in the permissive position. Optionally, cabinet 120 may define a shield pocket 324 within which signal shield 310 is slidably received. For instance, in the permissive position, signal shield 310 may generally be received within a shield pocket 324 and hidden from a user's view. Nonetheless, even in the permissive position, front shield end 320 may be visible or even held outside of cabinet 120. By contrast, rear shield end 322 may be held within cabinet 120 in both the blocking position and the permissive position.

Figure 19:
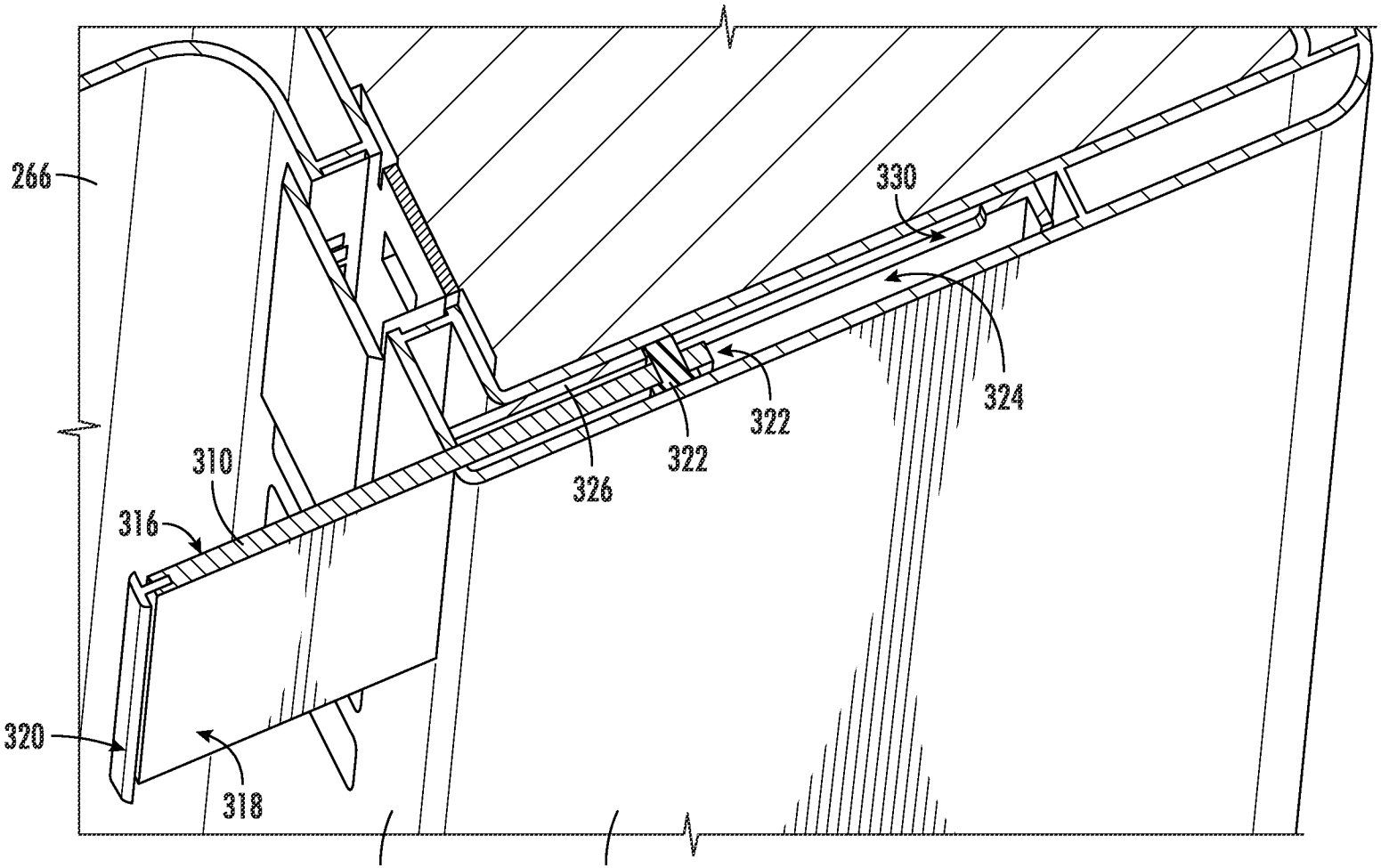
FIG. 19 provides another cross-sectional perspective view of the signal shield within the cabinet of the exemplary beverage-dispensing appliance of FIG. 1.
Figure 20:
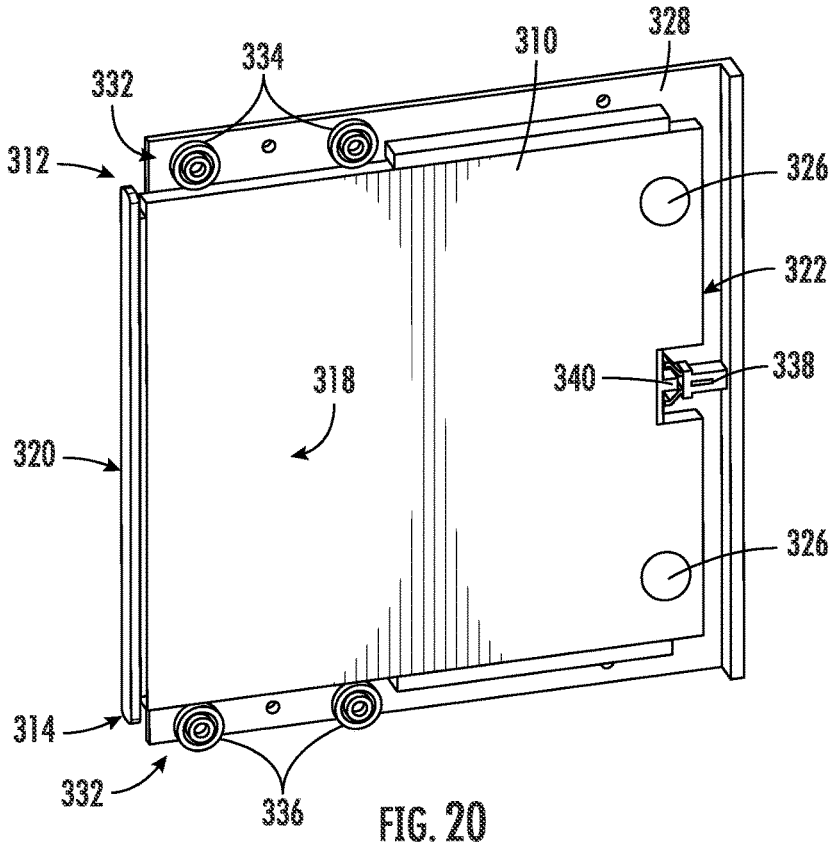
FIG. 20 provides a perspective view of the signal shield, in isolation, of the exemplary beverage-dispensing appliance of FIG. 1, wherein the signal shield is in the permissive position.
Figure 21:
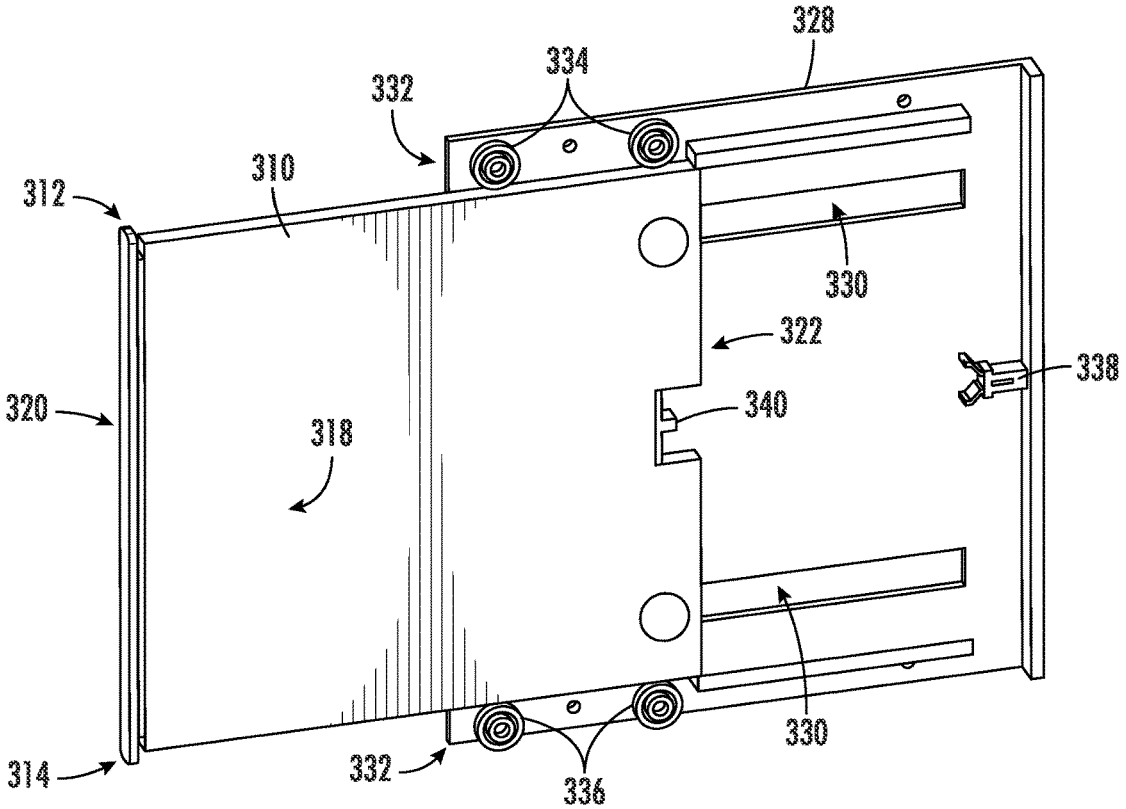
FIG. 21 provides a perspective view of the signal shield, in isolation, of the exemplary beverage-dispensing appliance of FIG. 1, wherein the signal shield is in the blocking position.

A restrictor pin 326 disposed between rear shield end 322 and front shield end 320 may further be held within cabinet 120 and extend (e.g., laterally) from signal shield 310. For instance, restrictor pin 326 may be disposed on and fixed relative to signal shield 310. A mounting plate 328 of cabinet 120 may define a groove 330 within which restrictor pin 326 may slide. In some such embodiments, the groove 330 defines a forward extreme or rearward extreme for movement of signal shield 310. As signal shield 310 moves between the blocking position and permissive position, engagement or contact between the restrictor pin 326 and the front or rear end of groove 330 may thus prevent further transversal movement of signal shield 310 (e.g., as illustrated in FIG. 19 or the phantom lines of FIG. 18).

In optional embodiments, a roller assembly 332 is provided (e.g., within cabinet 120) and generally guides signal shield 310 (e.g., along the transverse direction T). Specifically, one or more rollers may be rotatably disposed within cabinet 120 (e.g., on mounting plate 328) in support of signal shield 310. As an example, one or more top rollers 334 may be rotatably fixed within cabinet 120 above signal shield 310. As shown, such top rollers 334 may be disposed on an upper edge of signal shield 310 (e.g., in contact with the same). Thus, movement of signal shield 310 along the transverse direction T may cause the top rollers 334 to rotate, facilitating smooth or low-resistance movement of signal shield 310. As an additional or alternative example, one or more bottom rollers 336 may be rotatably fixed within cabinet 120 below signal shield 310. As shown, such bottom rollers 336 may be disposed on a lower edge of signal shield 310 (e.g., in contact with the same). Thus, movement of signal shield 310 along the transverse direction T may cause the bottom rollers 336 to rotate, facilitating smooth or low-resistance movement of signal shield 310.

Additional or alternative embodiments may include a push-to-open latch 338. As illustrated, push-to-open latch 338 may be mounted within cabinet 120 (e.g., on mounting plate 328) in selective engagement with signal shield 310. As would be understood, a reciprocating plunger of push-to-open latch 338 may selectively cam between a retracted position (e.g., corresponding to the blocking position) and an extended position (e.g., corresponding to the permissive position). A mated prong 340 of signal shield 310 may extend (e.g., rearward) to selectively engage or contact push-to-open latch 338.

Although a sliding signal shield 310 is described above with respect to FIGS. 10 through 21, another suitable movable mounting for signal shield 310 may be provided, as would be understood in light of the present disclosure. For instance, turning briefly to FIGS. 22 through 25, signal shield 310 may be pivotably mounted to cabinet 120. In particular, signal shield 310 may be pivotable or rotatable about a pivot axis A between the blocking position and the permissive position. Although movement signal shield 310 may be distinct from that described above, it is understood that the blocking position may be generally the same the blocking position described above. As would be understood, the permissive position of the signal shield 310 may still provide signal shield 310 apart (e.g., rearward) from dispenser recess 144.

Figure 22:
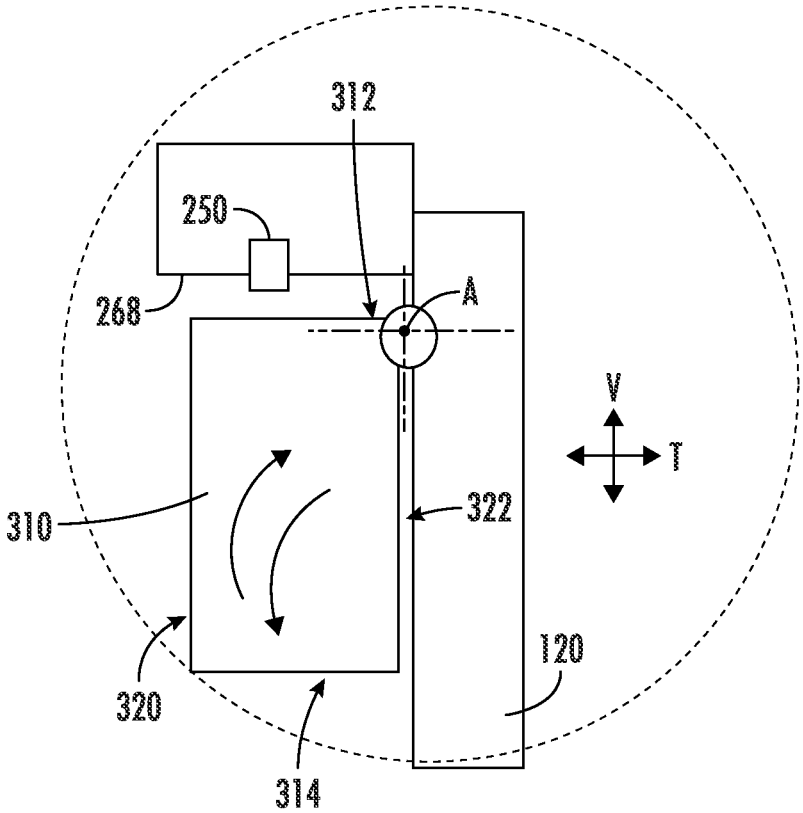
FIG. 22 provides a schematic, side, elevation view of a signal shield of a beverage-dispensing appliance according to exemplary embodiments of the present disclosure.
Figure 23:
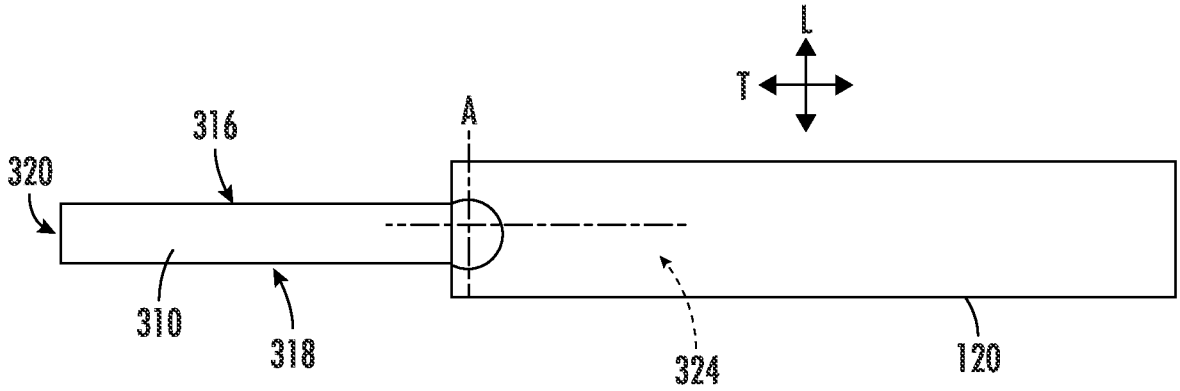
FIG. 23 provides a schematic, top, perspective view of the exemplary signal shield of FIG. 22.

In specific embodiments, such as those illustrated in FIGS. 22 and 23, signal shield 310 may be pivotably mounted at top shield end 312. Thus, an upper hinge may be provided to allow the rear shield end 322 to rotate rearward and upward from the blocking position (shown) to the permissive position (not shown). Optionally, cabinet 120 may define a shield pocket 324 within which signal shield 310 is rotatably received. For instance, in the permissive position, signal shield 310 may generally be received within a shield pocket 324 and hidden from a user's view. Nonetheless, even in the permissive position, top shield end 312 may be visible or even held outside of cabinet 120. By contrast, front shield end 320 may be held within cabinet 120 in the permissive position.

Figure 24:
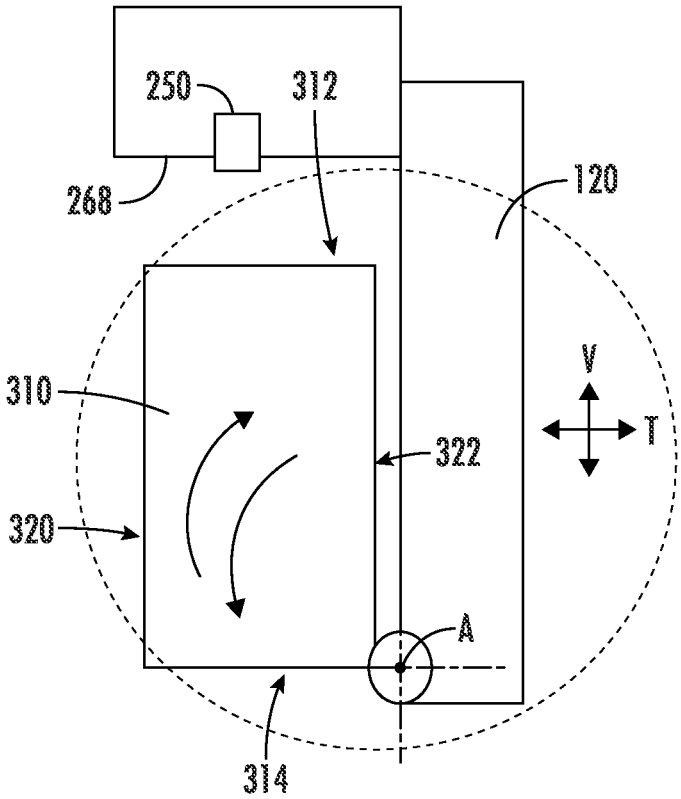
FIG. 24 provides a schematic, side, elevation view of a signal shield of a beverage-dispensing appliance according to exemplary embodiments of the present disclosure.
Figure 25:
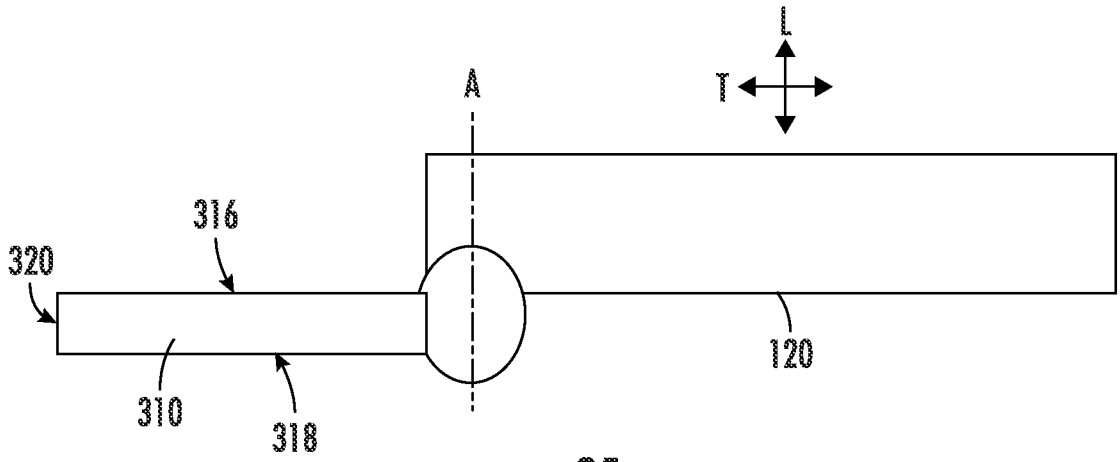
FIG. 25 provides a schematic, top, perspective view of the exemplary signal shield of FIG. 24.

In alternative embodiments, such as those illustrated in FIGS. 24 and 25, signal shield 310 may be pivotably mounted at bottom shield end 314. Thus, a lower hinge may be provided to allow the rear shield end 322 to rotate rearward and downward from the blocking position (shown) to the permissive position (not shown). Optionally, signal shield 310 may be held outside of cabinet 120. For instance, signal shield 310 may be rotatably mounted on an outer wall of cabinet 120 and disposed laterally outward from cabinet 120. Thus, while signal shield 310 may be moved relative to dispenser recess 144, substantially all of signal shield 310 may be visible in both the blocking position and the permissive position.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A beverage-dispensing appliance comprising:

a cabinet defining a mutually-orthogonal vertical direction, lateral direction, and transverse direction, the cabinet defining a dispenser recess;

a liquid line mounted to the cabinet and defining a liquid outlet above the dispenser recess;

a liquid level sensor mounted to the cabinet and directed at the dispenser recess; and a signal shield movably mounted to the cabinet, the signal shield being movable between a blocking position and a permissive position, the blocking position laterally bounding at least a portion of the dispenser recess, the permissive position being transversely spaced apart from the dispenser recess to permit lateral access thereto, wherein the dispenser recess extends along the lateral direction between a first recess side and a second recess side, wherein the signal shield is disposed at the second recess side, and wherein a static wall is disposed at the first recess side to fixedly bound the dispenser recess.

2. The beverage-dispensing appliance of claim 1, further comprising a container tray disposed below a bottom shield end of the signal shield at the blocking position.

3. The beverage-dispensing appliance of claim 1, further comprising a movable container tray selectively disposed within the dispenser recess.

4. The beverage-dispensing appliance of claim 3, wherein the movable container tray is selectively disposed directly beneath the liquid level sensor.

5. The beverage-dispensing appliance of claim 1, wherein the signal shield is slidably mounted on the cabinet to move along the transverse direction between the blocking position and the permissive position.

6. The beverage-dispensing appliance of claim 5, further comprising a roller assembly guiding the signal shield along the transverse direction, the roller assembly comprising a top roller rotatably fixed within the cabinet above the signal shield and a bottom roller rotatably fixed within the cabinet below the signal shield.

7. The beverage-dispensing appliance of claim 5, further comprising a push-to-open latch mounted within the cabinet in selective engagement with the signal shield.

8. The beverage-dispensing appliance of claim 1, wherein, in the permissive position, the signal shield is received within a shield pocket defined by the cabinet.

9. The beverage-dispensing appliance of claim 1, wherein the signal shield is pivotably mounted to the cabinet to rotate about a pivot axis between the blocking position and the permissive position.

10. A beverage-dispensing appliance comprising:

a cabinet defining a mutually-orthogonal vertical direction, lateral direction, and transverse direction, the cabinet defining a dispenser recess;

a liquid line mounted to the cabinet and defining a liquid outlet above the dispenser recess;

a liquid level sensor mounted to the cabinet above the dispenser recess;

a container tray disposed directly beneath the liquid outlet; and a signal shield movably mounted to the cabinet and laterally spaced apart from the liquid level sensor, the signal shield extending along the vertical direction from a top shield end to a bottom shield end, the bottom shield end being disposed below liquid level sensor, the signal shield being movable between a blocking position and a permissive position, the blocking position laterally bounding at least a portion of the dispenser recess and locating a front shield end of the signal shield forward from the liquid level sensor, the permissive position being transversely spaced apart from the dispenser recess and locating the front shield end of the signal shield rearward from the liquid level sensor.

11. The beverage-dispensing appliance of claim 10, wherein the dispenser recess extends along the lateral direction between a first recess side and a second recess side, wherein the signal shield is disposed at the second recess side, and wherein a static wall is disposed at the first recess side to fixedly bound the dispenser recess.

12. The beverage-dispensing appliance of claim 10, wherein the container tray is disposed below a bottom shield end of the signal shield at the blocking position.

13. The beverage-dispensing appliance of claim 12, wherein the container tray is selectively disposed within the dispenser recess.

14. The beverage-dispensing appliance of claim 12, wherein the container tray is selectively disposed directly beneath the liquid level sensor.

15. The beverage-dispensing appliance of claim 10, wherein the signal shield is slidably mounted on the cabinet to move along the transverse direction between the blocking position and the permissive position.

16. The beverage-dispensing appliance of claim 15, further comprising a roller assembly guiding the signal shield along the transverse direction, the roller assembly comprising a top roller rotatably fixed within the cabinet above the signal shield and a bottom roller rotatably fixed within the cabinet below the signal shield.

17. The beverage-dispensing appliance of claim 15, further comprising a push-to-open latch mounted within the cabinet in selective engagement with the signal shield.

18. The beverage-dispensing appliance of claim 10, wherein, in the permissive position, the signal shield is received within a shield pocket defined by the cabinet.

19. The beverage-dispensing appliance of claim 10, wherein the signal shield is pivotably mounted to the cabinet to rotate about a pivot axis between the blocking position and the permissive position.

20. A beverage-dispensing appliance comprising:

a cabinet defining a mutually-orthogonal vertical direction, lateral direction, and transverse direction, the cabinet defining a dispenser recess;

a liquid line mounted to the cabinet and defining a liquid outlet above the dispenser recess;

a liquid level sensor mounted to the cabinet and directed at the dispenser recess; and a signal shield movably mounted to the cabinet, the signal shield being movable between a blocking position and a permissive position, the blocking position laterally bounding at least a portion of the dispenser recess, the permissive position being transversely spaced apart from the dispenser recess to permit lateral access thereto, wherein the signal shield is slidably mounted on the cabinet to move along the transverse direction between the blocking position and the permissive position.

* * * * *